US012788143B2

(12) United States Patent
McClairen et al.

(10) Patent No.: US 12,788,143 B2
(45) Date of Patent: Nov. 10, 2026

(54) PORTABLE CHAIR

(71) Applicants: Lubertha McClairen, West Des Moines, IA (US); Ashton Duea, Urbandale, IA (US)

(72) Inventors: Lubertha McClairen, West Des Moines, IA (US); Ashton Duea, Urbandale, IA (US)

( * ) Notice: Subject to any disclaimer, the term of this patent is extended or adjusted under 35 U.S.C. 154(b) by 167 days.

(21) Appl. No.: 18/671,753

(22) Filed: May 22, 2024

(65) Prior Publication Data

US 2025/0359673 A1 Nov. 27, 2025

(51) Int. Cl.

| | |
|---|---|
| ***A47C 1/16*** | (2006.01) |
| ***A47C 4/42*** | (2006.01) |
| ***A47C 7/38*** | (2006.01) |
| ***A47C 7/54*** | (2006.01) |
| ***A47C 7/62*** | (2006.01) |
| ***A47C 7/66*** | (2006.01) |
| ***A47C 7/68*** | (2006.01) |

(52) U.S. Cl.

CPC ..... *A47C 1/16* (2013.01); *A47C 4/42* (2013.01); *A47C 7/383* (2013.01); *A47C 7/546* (2013.01); *A47C 7/624* (2018.08); *A47C 7/666* (2018.08); *A47C 7/705* (2018.08)

(58) Field of Classification Search

CPC ..... A47C 1/16; A47C 7/66; A47C 7/666

USPC ..... 297/252, 256.16

See application file for complete search history.

(56) References Cited

U.S. PATENT DOCUMENTS

| | | | | | |
|---|---|---|---|---|---|
| 520,284 | A | * | 5/1894 | Wonson et al. | A47C 7/70 297/145 |
| 1,162,540 | A | * | 11/1915 | Adams | A47C 1/146 135/96 |
| 2,108,531 | A | | 2/1938 | Flanders | |
| 2,158,247 | A | * | 5/1939 | Newport | A47C 1/16 297/352 |

(Continued)

FOREIGN PATENT DOCUMENTS

| | | | |
|---|---|---|---|
| AU | 9523398 | A | 5/1999 |
| CN | 207186374 | U | 4/2018 |
| GB | 2204264 | A | 11/1988 |

OTHER PUBLICATIONS

International Search Report and the Written Opinion, PCT/US2025/029663, Sep. 4, 2025, 16 Pages.

*Primary Examiner* — Joshua J Michener
*Assistant Examiner* — Nevena Aleksic
(74) *Attorney, Agent, or Firm* — Goodhue, Coleman & Owens, P.C.

(57) ABSTRACT

A portable chair includes a base assembly comprising a base frame and a seat cushion fit to the base frame, a back assembly operatively connected to the base assembly, a first set of clamps operatively connected to a front of the base assembly and configured to extend downwardly therefrom to secure the portable chair to a surface, and a second set of clamps operatively connected to a back of the base assembly and configured to extend downwardly therefrom to further secure the portable chair to the surface. The chair may further include a canopy which may be secured at both ends, a removable pouch, a removable head rest, a removable tray, and retractable legs. The chair may include a kickstand and may include additional sets of clamps for attaching to different surfaces. Fabric connectors may be used through the portable chair and accessories.

20 Claims, 20 Drawing Sheets

(56) References Cited

U.S. PATENT DOCUMENTS 2,220,865 A 11/1940 Hines
2,480,310 A * 8/1949 Torrey ..... A47C 1/16 297/452.13
2,480,402 A * 8/1949 Elston ..... B63C 15/00 224/155
2,518,057 A * 8/1950 Orth ..... A47C 1/16 297/352
2,536,157 A * 1/1951 Campanelli ..... A47C 1/16 297/183.5
2,792,875 A * 5/1957 Pirrone ..... A47C 1/16 297/130
2,957,515 A * 10/1960 Gibson ..... A47C 1/16 297/440.11
2,989,099 A 6/1961 Damm
3,066,980 A 12/1962 Clute
3,594,039 A * 7/1971 Harp ..... A47C 7/66 297/188.1
3,879,086 A 4/1975 Moceri
3,994,529 A * 11/1976 Lippert ..... A47C 1/16 297/134
4,154,323 A 5/1979 Sneider
5,069,503 A * 12/1991 Martinez ..... A47C 1/146 297/378.12
5,168,889 A 12/1992 Diestel
5,439,154 A 8/1995 Delligatti
6,302,033 B1 10/2001 Roudebush
6,352,306 B1 * 3/2002 Dreiling ..... A47C 1/16 297/252
6,926,360 B2 8/2005 Jones
7,316,452 B2 1/2008 Vestweber
7,530,635 B2 5/2009 Schramek-Flye
7,631,934 B2 12/2009 Mac Isaac
8,434,827 B2 5/2013 Young et al.
9,808,097 B2 11/2017 Whitt et al.
10,966,529 B1 * 4/2021 Downs ..... A47C 7/70
10,980,347 B1 * 4/2021 Levin ..... A47C 4/02
11,369,200 B2 * 6/2022 Sun ..... A47C 7/543
11,877,660 B2 * 1/2024 Plant ..... A47C 1/16
12,336,632 B2 * 6/2025 Schumacher ..... A47C 1/16
2004/0061297 A1 4/2004 Booker
2008/0149580 A1 6/2008 Hill
2010/0015882 A1 * 1/2010 Givens ..... A63H 33/006 446/227
2011/0049942 A1 * 3/2011 Gorinas ..... A47C 7/626 297/118
2011/0272984 A1 * 11/2011 Vestweber ..... A47C 1/16 297/252
2012/0273384 A1 11/2012 Jaswal
2017/0238719 A1 * 8/2017 Whitt ..... A47C 7/425
2020/0405063 A1 * 12/2020 Bulger ..... A47C 13/00
2021/0106451 A1 * 4/2021 Wolfer ..... A47C 7/36
2021/0321776 A1 10/2021 Plant
2021/0331804 A1 * 10/2021 Frost ..... B64D 11/0638
2021/0368990 A1 * 12/2021 Holland ..... A47C 7/666
2023/0097095 A1 * 3/2023 Coleman ..... A47C 1/16 297/19
2024/0108137 A1 4/2024 Schumacher
2024/0341480 A1 * 10/2024 Davis ..... A47C 4/18
2025/0107628 A1 * 4/2025 Xue ..... A47C 7/666

* cited by examiner

PORTABLE CHAIR

FIELD OF THE DISCLOSURE

The present disclosure relates to chairs. More particularly, but not exclusively, the present disclosure relates to a portable chair.

BACKGROUND OF THE ART

Although problems in the art are described with respect to several different applications for a portable chair, the present disclosure is not to be limited by or to these specific applications. One such use of portable chairs is in the context of portable, foldable stadium chairs. Portable stadium chairs may be used by individuals who desire more support or comfort than may be provided by typical stadium chairs, bleachers, or benches.

Another use of portable chairs is specific to adaptive chairs. Adaptive chairs are generally specialized chairs designed to provide comfort, support, and improved posture for individuals with disabilities. Such chairs may require adjustability to fit to an individual's body, while still providing support, include relevant safety features, and are easy for caregivers to use and/or transport.

Yet another use of portable chairs is for children or infants. Portable chairs for infants may be used to support an infant in any number of different environments.

Thus, there are various situations where a portable chair is desirable. Yet despite various attempts at different chairs, problems remain.

SUMMARY

Therefore, it is a primary object, feature, or advantage of this disclosure to improve over the state of the art.

It is a further object, feature, or advantage to increase functionality of a chair.

It is a still further object, feature, or advantage to provide a chair which is adaptable to better meet the needs of a range of users including infants, toddlers, children, adults, people with disabilities.

It is a further object, feature, or advantage to provide a chair tray which enhances safety for infants, toddlers, or people with disabilities.

Another object, feature, or advantage is to provide a chair which allows for use of a removable attachable canopy which may be secured in place on two sides.

Yet another object, feature, or advantage is to provide a chair with a removable tray which may be used for eating or for playing.

A still further object, feature, or advantage is to provide a chair which allows for securing an individual in a safe manner.

Another object, feature, or advantage is to provide a chair with a removable pouch which may be used for storage.

Yet another object, feature, or advantage is a chair with a removable pouch which may accommodate the canopy when it is detached and/or the tray when it is detached.

It is a further object, feature, or advantage to provide a chair which is readily attachable to a bleacher, bench, or other chair.

A still further object, feature, or advantage is to provide a chair which may be free-standing through the use of a kickstand and/or foldable legs.

Another object, feature, or advantage is to provide a chair with clamps and straps to provide a chair which is ideal for both indoor and outdoor activities.

Yet another object, feature, or advantage is to provide a chair with front and rear straps which allow the chair to attach to indoor bleachers.

A further object, feature, or advantage is to provide a chair which can be attached as a booster seat such that a highchair is not required.

A still further object, feature, or advantage is to provide a chair which is compact in size to allow for greater mobility than a highchair.

Another object, feature, or advantage is to provide a chair which can be used in any number of indoor and outdoor environments including at restaurants, hotels, or at home or on the go such as at outdoor or indoor sporting activities or relaxing.

A further object, feature, or advantage is to use fabric connections such as VELCRO material type connections throughout a chair and its accessories.

One or more of these and/or other objects, features, or advantages will become apparent from the disclosure that follows. No single embodiment of a chair need provide each and every object, feature, or advantage, it is contemplated that different embodiments may have different features.

According to one aspect a portable chair includes a base assembly having a base frame and a seat cushion fit to the base frame. The portable chair further includes a back assembly operatively connected to the base assembly. The portable chair may include a first set of front clamps operatively connected to the base assembly in an operative position configured to extend downwardly therefrom to secure the portable chair to a front of a surface and in a stowed position positioned underneath the base. The portable chair may further include a set of back clamps operatively connected to the base assembly and in an operative position configured to extend downwardly therefrom to further secure the portable chair to a back of the surface and in a stowed position positioned underneath the base assembly. The portable chair may further include a second set of front clamps sized differently than the first set of front clamps and in an operative position configured to extend downwardly from the base assembly to secure the portable chair to the front of the surface and in a stowed position positioned underneath the base assembly. The portably chair may further include a left arm rest operatively connected to the back assembly and a right arm rest pivotably connected the back assembly. The portable chair may further include a kickstand pivotable connected to the back assembly and configured to support the portable chair when the kickstand is pivoted away from the back assembly. The portable chair may further include a plurality of pockets inset in the base assembly. The portable chair may further include a canopy comprising a plurality of rims and a covering with fabric fasteners secured to the covering. The portable chair may further include a first clamp assembly and a second clamp assembly for securing opposite sides of the canopy to the back assembly. Each of the first clamp assembly and the second clamp assembly may include a jaw claw lock handle and a knob attached to a threaded stud. The chair may further include a tray assembly for attaching to the left arm rest and the right arm rest. The tray assembly may include a left side and a right side separated from the left side and wherein both the left side and the right side comprise a cushion overlaying a protective surface. The portable chair may further include a carrying strap operatively connected to the tray assembly. The portable chair may further include a pouch removably connected to a rear of the back assembly and wherein the pouch is sufficiently sized to contain a removable canopy of the portable chair and a removable tray of the chair.

According to another aspect, a portable chair includes a base assembly having a base frame and a seat cushion fit to the base frame. The portable chair further includes a back assembly operatively connected to the base assembly, a first set of clamps operatively connected to the base assembly underneath a front of the base assembly and configured to extend downwardly therefrom to secure the portable chair to a surface, and a second set of clamps operatively connected to the base assembly underneath a back of the base assembly and configured to extend downwardly therefrom to further secure the portable chair to the surface. The portable chair further includes a left arm rest operatively connected to the back assembly and a right arm rest operatively connected to the back assembly. The portable chair further includes a kickstand pivotable connected to the back assembly and configured to support the portable chair when the kickstand is pivoted away from the back assembly. The portable chair may further include a tray assembly for attaching to the left arm rest and the right arm rest. The tray assembly may include a left side and a right side separated from the left side and wherein both the left side and the right side comprise a cushion overlaying a protective surface. The portable chair may further include a canopy having a plurality of rims and a covering, a first clamp assembly and a second clamp assembly for securing opposite sides of the canopy to the back assembly. Each of the first clamp assembly and the second clamp assembly comprises a jaw claw lock handle and a knob attached to a threaded stud. The portable chair may further include a pouch removably connected to a rear of the back assembly and wherein the pouch is sufficiently sized to contain the canopy of the portable chair and the tray assembly of the chair. The portable chair may further include a head rest removably connected to the back assembly and sized to fit within the pouch. The portable chair may further include at least one retractable leg operatively connected to the base assembly.

According to another aspect, the present disclosure relates to a portable chair designed to enhance user comfort and functionality in various settings. The chair includes a base assembly having a base frame and a cushion, and a back assembly operatively connected to the base. To ensure stability and security when deployed, the chair is equipped with two sets of clamps. The first set is located at the front of the base assembly, while the second set is situated at the back to secure the chair to another surface.

According to another aspect, a portable chair includes a base assembly having a base frame and a seat cushion fit to the base frame, a back assembly operatively connected to the base assembly, a first set of clamps operatively connected to a front of the base assembly and configured to extend downwardly therefrom to secure the portable chair to a surface, a second set of clamps operatively connected to a back of the base assembly and configured to extend downwardly therefrom to further secure the portable chair to the surface, a left arm rest operatively connected to the base assembly and a right arm rest operatively connected the base assembly, both the left arm rest and the right arm rest extending vertically upwards from the base assembly, and a kickstand pivotable connected to the back assembly and configured to support the portable chair when the kickstand is pivoted away from the back assembly. The portable chair may further include a tray assembly for attaching to the left arm rest and the right arm rest. The tray assembly may include a left side and a right side separated from the left side and wherein both the left side and the right side comprise a protective surface overlaying a cushion. The portable chair may further include a canopy having a plurality of rims and a covering. The portable chair may include a first clamp assembly and a second clamp assembly for securing opposite sides of the canopy to the back assembly. Each of the first clamp assembly and the second clamp assembly may include a jaw claw lock handle and a knob attached to a threaded stud. The portable chair may further include a pouch removably connected to a rear of the back assembly and wherein the pouch is sufficiently sized to contain the canopy of the portable chair and the tray assembly of the chair.

According to another aspect, a portable chair comprises a plurality of fabric connectors such as VELCRO material which may be used to secure different portions of the portable chair and its accessories. This includes using the fabric connectors for securing removable arm rests, a tray, blankets. This further includes maintaining the position of the chair in a closed position for transport. This further includes using fabric connectors on a chair back to secure a canopy. This further includes using fabric connectors to secure a pouch to a chair. Other structures include a back canopy flap to secure the back canopy flap to a top of the chair with fabric connectors to allow air flow through the canopy. Fabric connectors such as VELCRO material may also be used to reinforce and hold a tray together.

DETAILED DESCRIPTION

Generally, the present disclosure relates to a chair or seating which is portable, comfortable, convenient, and adaptable. Although there are a number of different use cases for the chair, some of which are emphasized herein, it is to be understood that the chair is not to be limited by or to these particular use cases.

One such use case is for children and protected classes of individuals who may especially benefit from additional safety features. Moreover, in such cases, the benefits of the chair are not only for the individual (e.g., child) but also for the caregiver who may be responsible for storing the chair, transporting the chair, and adjusting the chair for the benefit of the individual.

Another use case is for adults or other individuals who may use the chair for their own comfort such as for stadium seating or to attach it to a bench, or another chair. It should be understood that different embodiments of the chair need only include a subset of the features shown and described as may be appropriate for the particular use case. For example, although a five-point safety harness is shown which may be appropriate for a child or other individual, it would not be a necessary safety feature for all individuals. It is to be further understood that even for the same use case, not all features shown and described are required but instead may be optional. In addition, various components are removable and stowable.

Where a chair is intended for a larger individual such as an adult, it should be understood that different component parts such as the seat base, seat back, arm rests may be larger and/or made from additional or stronger or more durable material. For example for an adult, the chair may be made to accommodate a user weight capacity of up to 500 pounds but for an infant, toddler, or other child the weight capacity may be much less than that.

Figure 1:
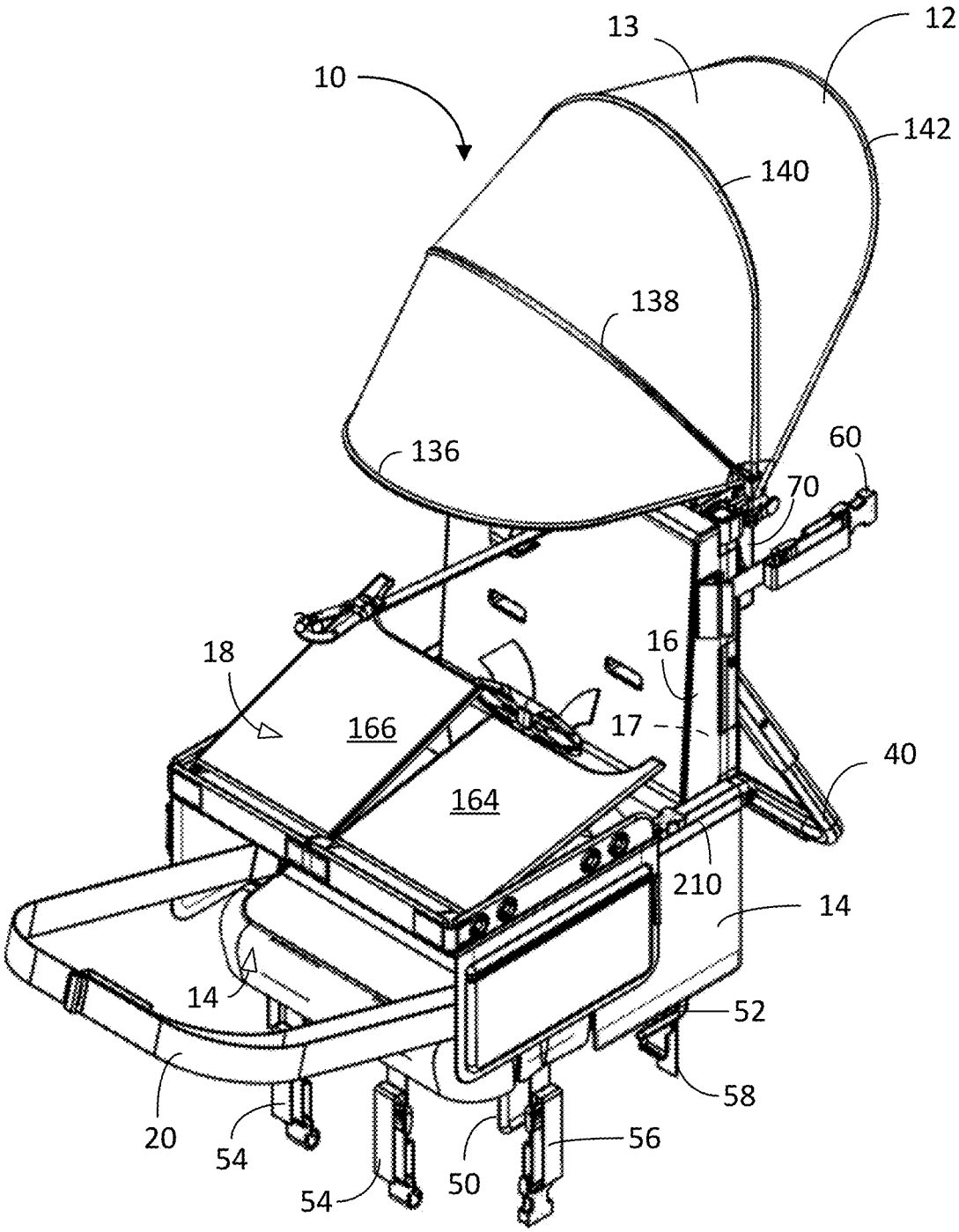
FIG. 1 illustrates one embodiment of a chair with a canopy present.

FIG. 1 illustrates one embodiment of a chair 10 with a canopy 12 present. The chair 10 shown in FIG. 1 is especially configured for use with a baby, toddler, or other child although may also be used with an adult in a protected class or other adult. The canopy 12 may serve as a sunscreen, umbrella, or privacy shield. The canopy 12 is foldable or collapsible and its position may be altered such as by pivoting the canopy 12. The canopy 12 is connected on both sides to the back assembly 16 of the chair. The canopy 12 has a plurality of rims 136, 138, 140, 142 with a covering 13 which may be a fabric covering. The canopy 12 may pivot at the rim pivot member 134. The canopy 12 may be removed and stored when not in use.

The chair 10 also includes a base assembly 14 which is operatively connected to the back assembly 16. A tray assembly 18 is also shown which is also operatively connected to the base assembly 14. As shown the tray assembly 18 has two top tray surfaces 160, 162 which may be a top protective surface which overlays a cushion or bottom portions 164, 166. The tray assembly 18 may be used to provide a surface for food or drink to be placed or to serve as a play area such as for toys or a work surface such as for phones or tablets or other devices.

The chair 10 includes various strap assemblies for used for connecting various component pieces in a secure manner, secure an individual within the chair 10, and/or to provide a convenient manner for carrying or transporting the chair 10. For example, a carry strap 20 is shown which is operatively connected to the tray assembly 18 which allows the tray assembly 18 to be easily carried. There are front strap assemblies 54, side strap assembly 56, and rear strap assembly 58 which also for connecting the chair including when the chair 10 is resting on another surface. There are also front clamps 50 and rear clamps 52 which may be used when securing the chair 10 to a surface such as a bench, bleacher, or even another chair. Having both front clamps 50 and rear clamps 52 is advantageous as bleachers can at times be wet or slippery and may not be flat but may be inclined which can result in stadium chairs not being sufficiently secured.

The clamps 50, 52 beneath the base allow the chair 10 to be secured to different sizes of outdoor bleachers or other seating. There may be multiple sets of clamps to allow the chair to be secured to various sizes of benches, bleachers, or other seating. For example, there may be one set of clamps to allow for attachment to standard 11 inch bleachers and another set of clamps for attachment to 9 inch bleachers. There may be, for example, two sets of four clamps (one set for 11 inch bleachers and one set for 9 inch bleachers) beneath the base.

Various features of different strap assemblies include buckles for connecting with opposing strap assemblies.

In addition, on various surfaces, hook and loop fasteners such as VELCRO fasteners may be present to allow for connection of the straps to other straps or other portions of the chair 10. In such a configuration one strap assembly may have hooks and a connecting strap assembly may have loops so that when the two sides are pressed together, the hooks catch in the loops holding the surface together. Other types of fasteners may include other types of interlocking fabric fasteners, touch fasteners, textile connectors or others.

A kickstand 40 is present at the back of the chair 10. The kickstand 40 allows the chair 10 to be supported such as when the chair rests on the ground. The kickstand 40 may be telescoping in nature to allow for the kickstand 40 to be extended or retracted. In addition, the kickstand may be rotated to different positions to provide for different angles. In addition, or alternatively, to the kickstand, foldable legs may be provided which fold up underneath the base assembly 14. Where legs are present, the legs may be telescoping in nature.

Figure 2:
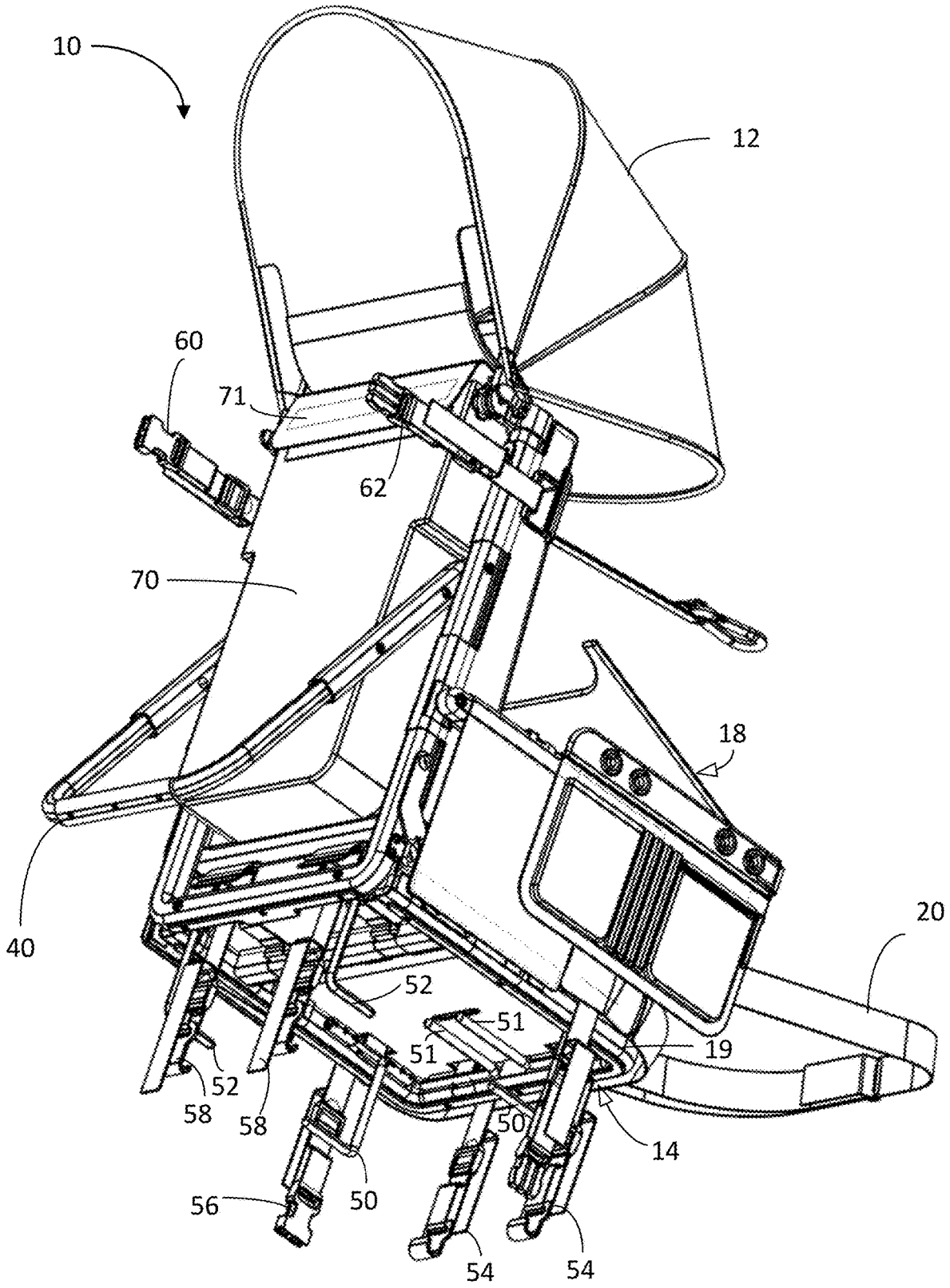
FIG. 2 illustrates the chair from a different angle.

FIG. 2 illustrates the chair 10 from a different angle. The view in FIG. 2 shows a pouch 70 which is removably secured to the back assembly 16 such as using VELCRO or other hook and loop fasteners. The pouch 70 may be of sufficient size so that the tray assembly 18 may be stored within the pouch 70 and the canopy 12 may be placed within the pouch 70 when they are not in use. This provides a significant advantage in that there is storage for removable portions of the chair which are integrated into the design of the chair. Thus, these attachments may be stored and conveyed with the chair and available when needed. Instead or in addition to storing these items and/or other attachments to the chair, the pouch 70 may be used for other purposes to store any items which one desires to store or transport. Fabric fastener 71 such as from hook and loop or VELCRO material may be operatively connected to a back flap of the pouch 70.

FIG. 2 further illustrates the front clamps 50 and back clamps 52 in an operative position. Another set of front clamps 51 are also shown in a stowed position. The chair 10 may include multiple sets of front clamps such as a first set of front clamps 50 and a second set of front clamps 51. Having multiple sets of clamps allows the chair to fit to different sizes of bleaches or benches. When one or more set of claims are not in use they may be stowed under the seat assembly. Around the bottom of the seat assembly 14 is an anti-slip material such as rubber which may surround the bottom of the seat assembly 14 so that when the chair 10 is rested on a surface the chair 10 does not slip on the surface.

Figure 3:
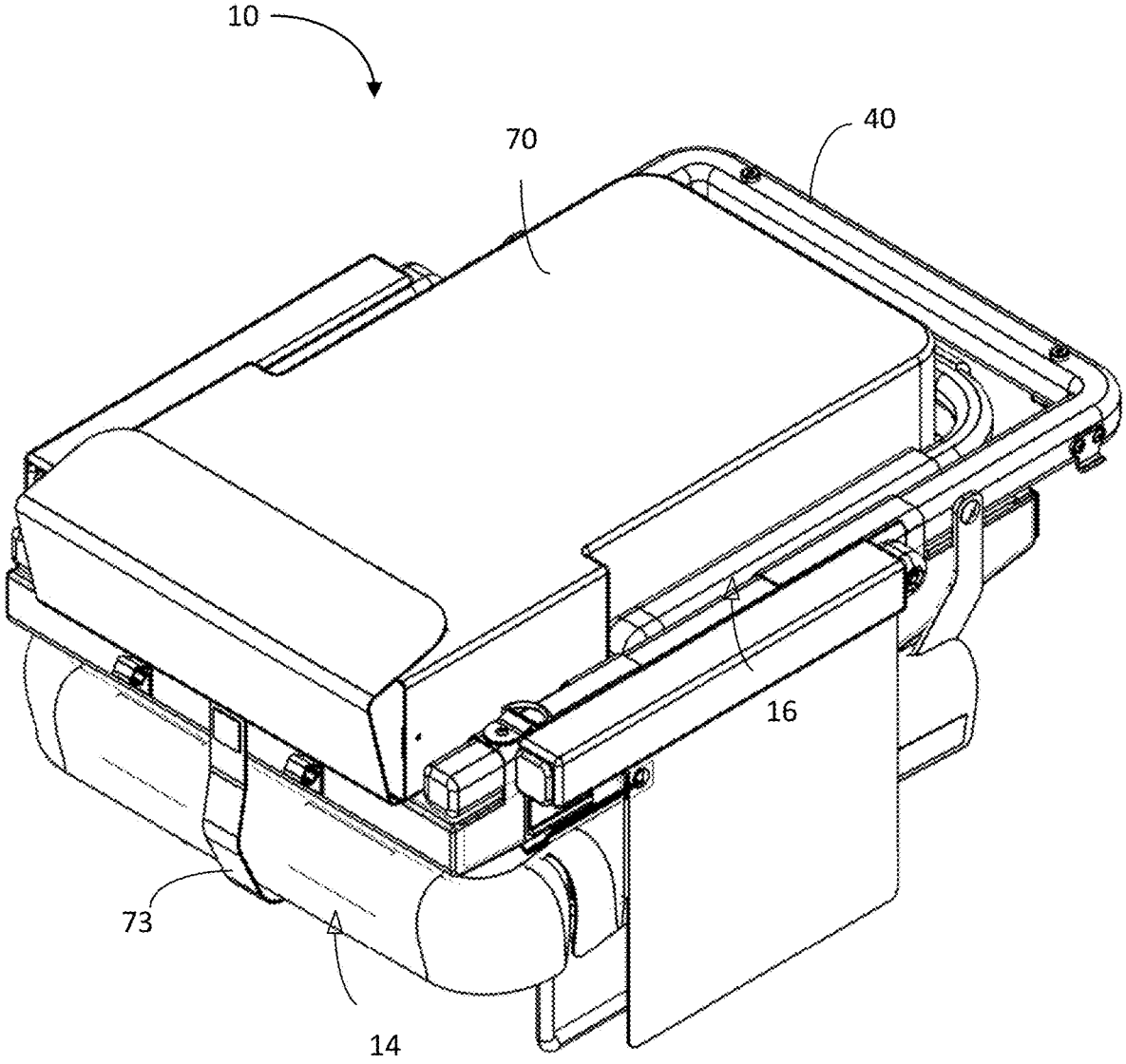
FIG. 3 illustrates the chair in a folded position.

FIG. 3 illustrates the chair 10 in a folded position. In the folded position, the base assembly 14 and the back assembly 16 are folded together. The pouch 70 is shown on top, above the kickstand 40. In this folded configuration, the chair 10 takes up little space and can be easily moved or stored. The canopy, tray assembly, or other items may be placed within the pouch 70 for storage or transport.

The pouch 70 may be removably attached or fastened to the chair such as with a fabric connectors such as a hook and loop type fastener formed using VELCRO material. The pouch 70 may be of sufficient size to hold the tray and canopy when they are not needed. Alternatively, the pouch may be used to hold other items such as may be associated with errands, play dates, a day at the park, a sports event, or otherwise. The pouch 70 may be removably attached to a back assembly of the chair so that it is convenient to insert items into the pouch 70 or remove items from the pouch then secure the pouch 70 to the chair 10 such that items are not lost and are readily available when needed. A closure tab 73 is also shown in FIG. 3. The closure tab 73 may be used to secure the chair 10 in a folded position.

Figure 4:
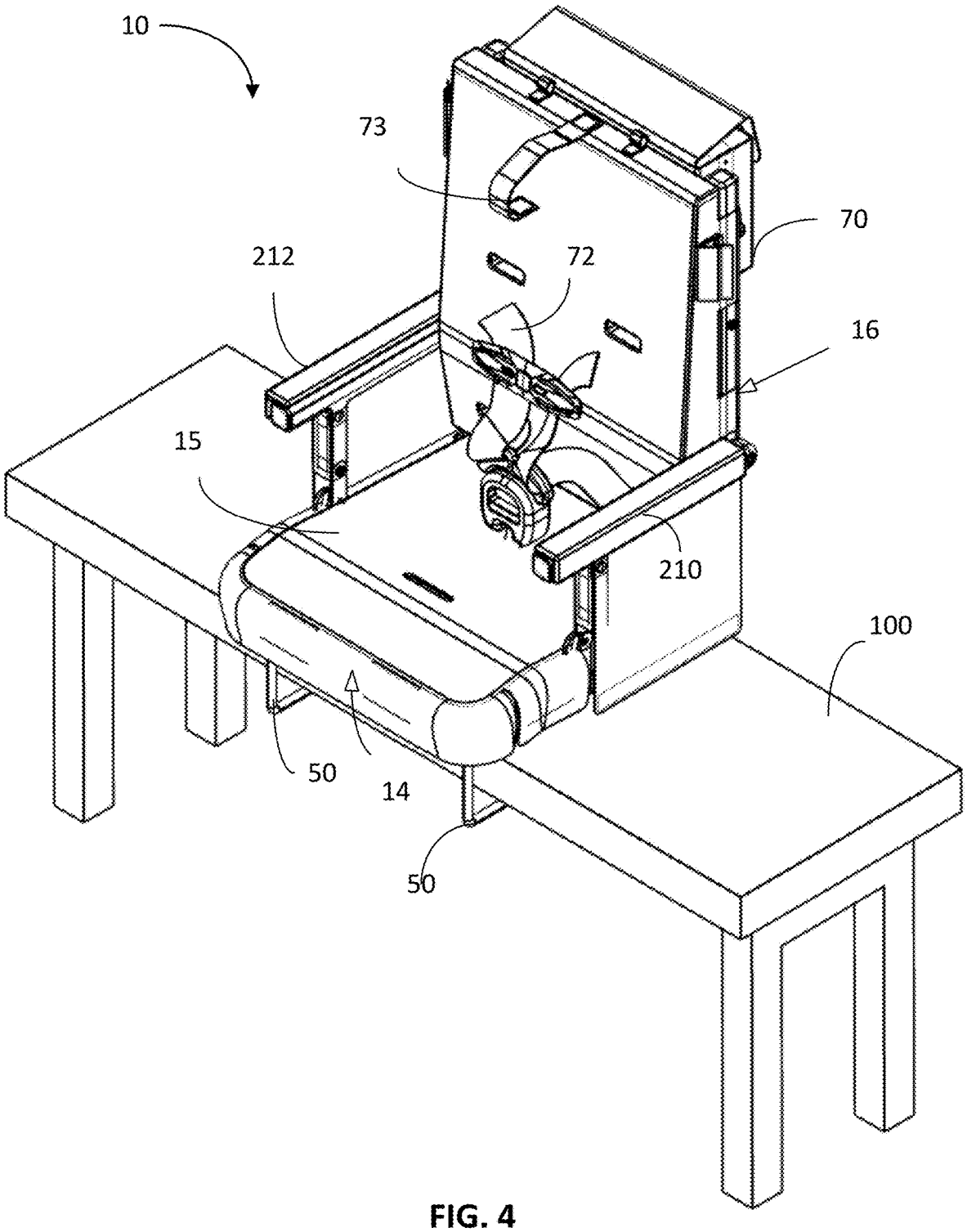
FIG. 4 illustrates the chair attached to a bench.
Figure 5:
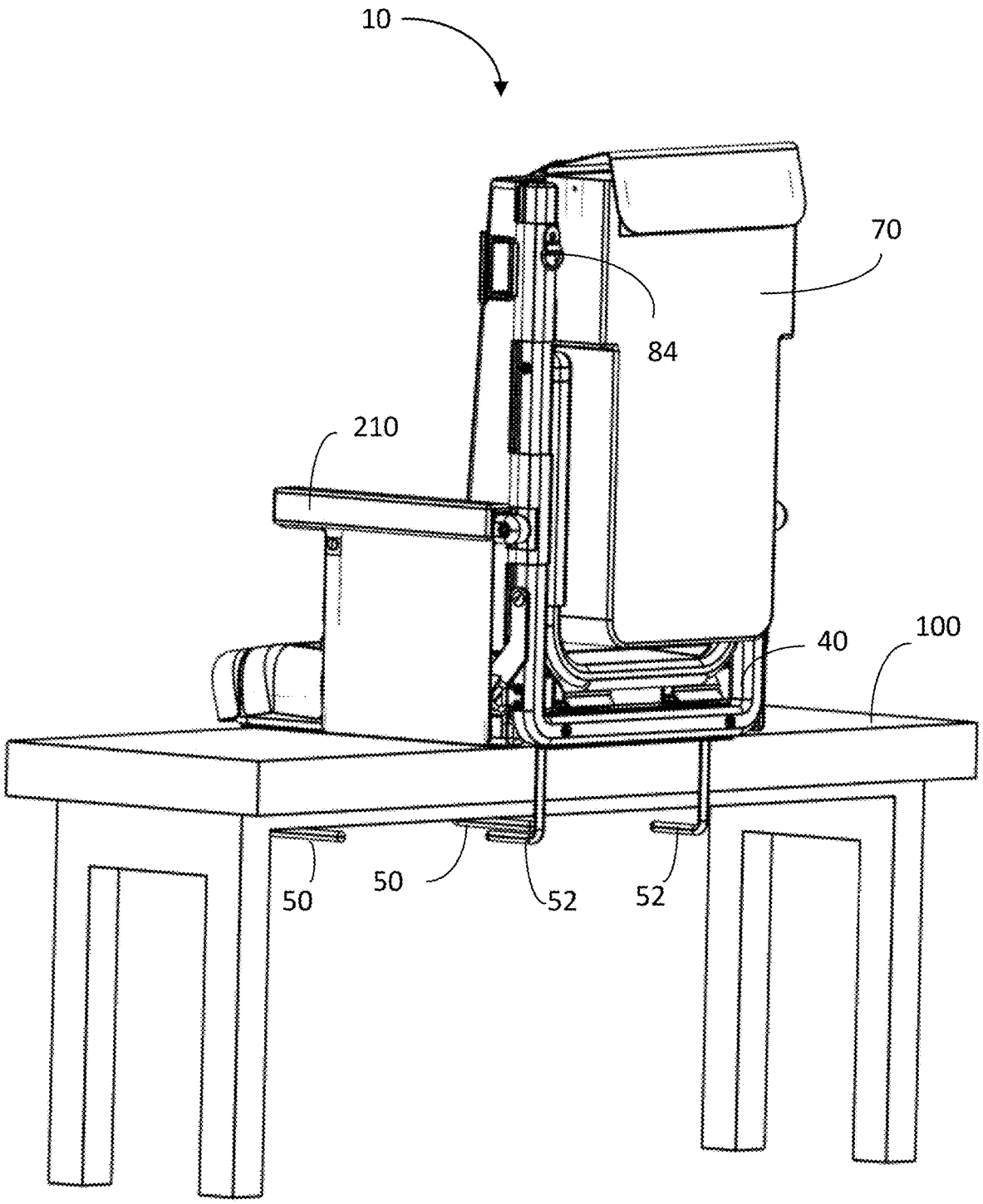
FIG. 5 further illustrates the chair 10 on the bench shown in FIG. 4 in a different view such that the clamps are also shown.

FIG. 4 illustrates an example of a chair 10 which is attached to a bench 100. Note that as shown in FIG. 5, the clamps 50 are shown in front which assist in securing the front of the base assembly 14 of the chair 10 to the surface of the bench 100. In the chair 10 shown, there is no canopy present and no tray present, however, it is to be understood that these component parts may be added including the canopy and tray and that these components may be stored within the pouch 70 which is removably attached to the back assembly 16. There are arm rests 210, 212 shown on opposite sides of the chair. The arm rests 210, 212 are removable. A harness 72 is also shown which may be used to secure the individual to the chair 10. The chair 10 includes a seating surface or seat cushion 15 which may be formed of fabric and/or cushioning.

FIG. 5 further illustrates the chair 10 on the bench 100 shown in FIG. 4 in a different view such that the clamps 52 are also shown. The clamps 52 allow for further securing the chair 10 at the back of the chair. Thus, when both clamps 50 are used and clamps 52 are used, the chair 10 is very securely secured to the bench 100. The clamps 50, 52 may also be considered legs or L-shaped legs. The front clamps 50 may be lower than the rear clamps 52. In addition, both the front clamps 50 and the rear clamps 52 may be rotated inwardly or outwardly to better secure the chair to avoid lateral movement. It is contemplated that more than one set of front clamps 50 may be provided to accommodate different widths of bleachers or benches.

Although a bench 100 is shown it is to be understood that the chair 10 may be secured to a bleacher or stadium seating in the same manner. In addition, as previously explained, the kickstand 40 may be extended so that the chair 10 may be supported on the ground or other surface. Alternatively, instead of a foldable kickstand in back, foldable and extendible legs may be positioned at the back of the chair. Similarly, one or more foldable and extendable legs may also be placed underneath the base assembly and fold out and optionally telescopically extend so that the base assembly is supported above the ground.

Also shown in FIG. 5 are anchors 84 which may be off-the-shelf (OTS) anchors which include a ring structure. The anchors 84 may be used to attach accessories in order to enhance the functionality of the chair 10.

Figure 6:
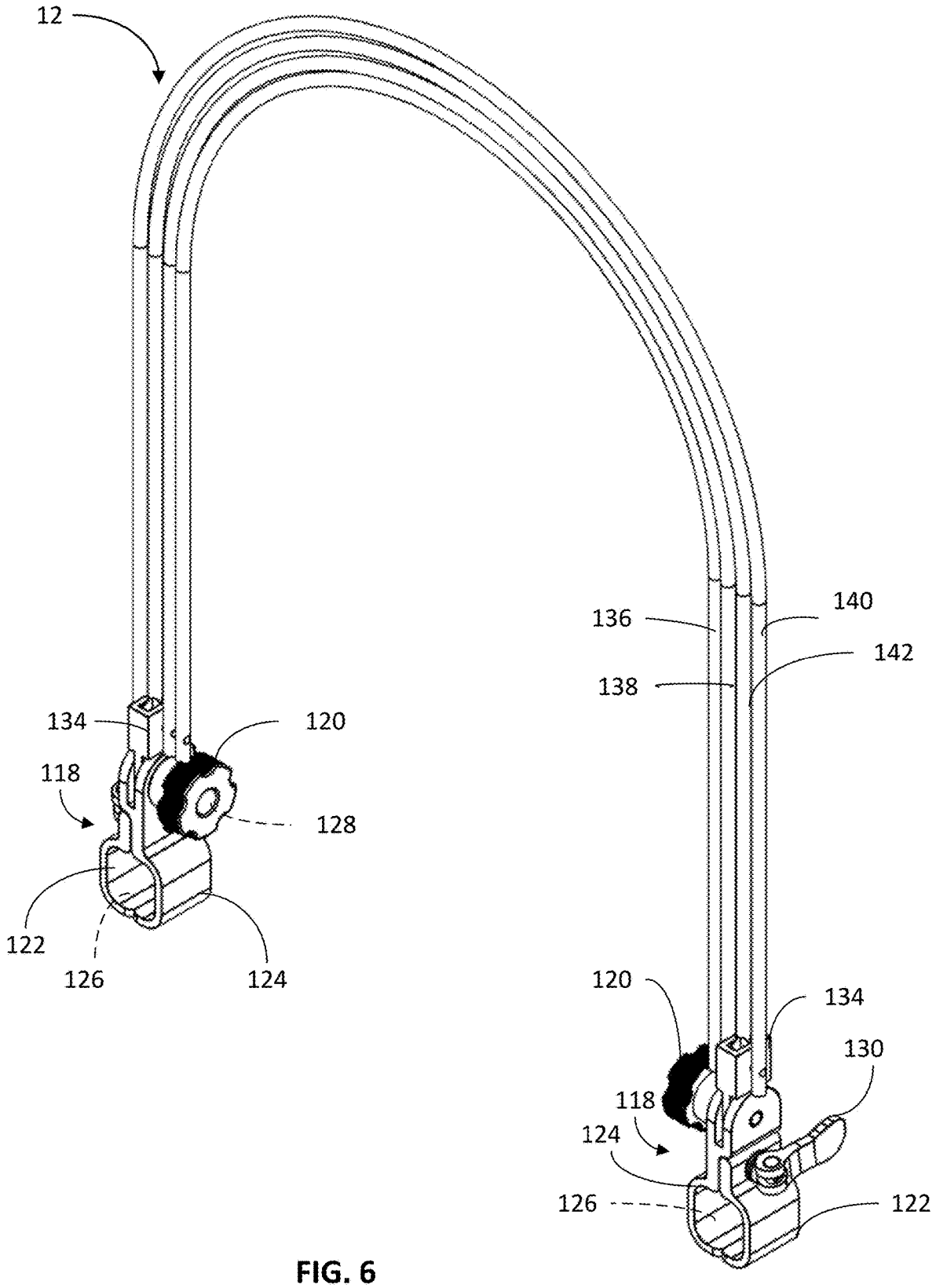
FIG. 6 illustrates the canopy in more detail.

FIG. 6 illustrates the canopy 12 in more detail. The canopy 12 includes first and second jaw clamp assemblies 118 on opposite ends of the canopy. Thus when the canopy 12 is secured to the chair it may be secured on both sides. Each jaw clamp assembly 118 has a first jaw camp member 122 and an opposite second jaw clamp member 124 which when clamped together on opposite sides of an opening 126 may hold the canopy to the frame of the chair. A knob 120 is shown which may be attached to a stud 128 having a threaded end (not shown) to allow the knob 120 to be used to tighten the stud 128 in order to secure the canopy 12. Once tightened, a locking handle 130 may be used in order secure a tight hold.

The canopy 12 may be removed by releasing the locking handle 130 and then turning the knob 120 in an opposite direction to unscrew the stud 128. Once unsecured in this manner, the canopy 12 may be removed. Once removed it may be folded and placed within the pouch of the chair.

The canopy 12 is constructed with a plurality of rims 136, 138, 140, 142 so as to make the canopy 12 collapsible for easy storage and transportation. A rim pivot member 134 is also shown to enable pivoting of the rims 136, 138, 140, 142, including allowing for pivoting between a storage position as shown and an operative position such as shown in FIG. 1. For purposes of explanation, the canopy 12 shown in FIG. 6 does not include a covering such as a fabric covering as shown in FIG. 1.

The canopy 12 provides added safety such as by protecting an individual from sun, precipitation, or wind. In addition, the canopy 12 can provide additional privacy and can act as a privacy shield. It should be understood that attachment and removal of the canopy 12 is a simple process. The canopy 12 as shown avoids problems with permanently attached canopies or canopies which attach on one side of a chair and thus lack stability on windy days (and can fly away) or do not allow for rotation for movement with the sun. Fabric connectors such as those made from VELCO material may be placed at various locations on the canopy 12 in order to facilitate different configurations of the canopy 12 during use.

Figure 7:
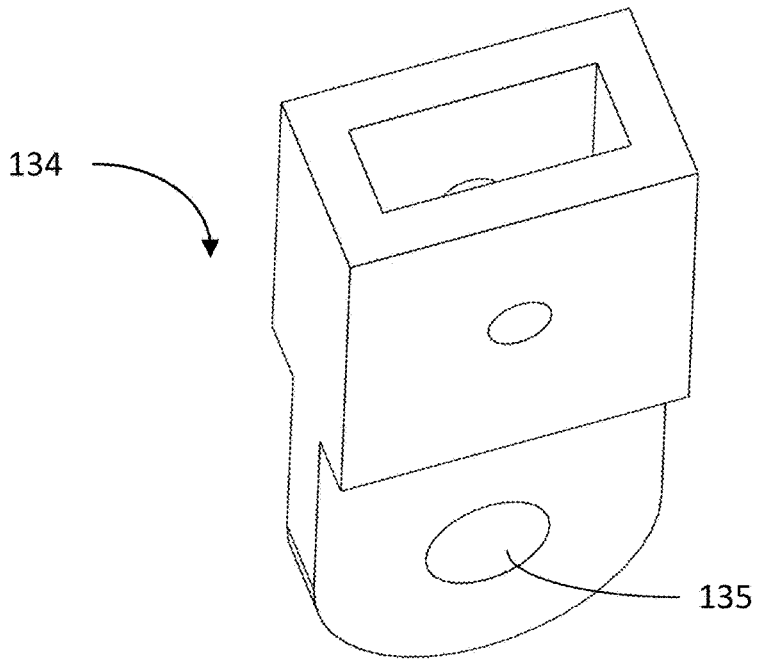
FIG. 7 further illustrates the rim pivot member of the canopy.
Figure 8:
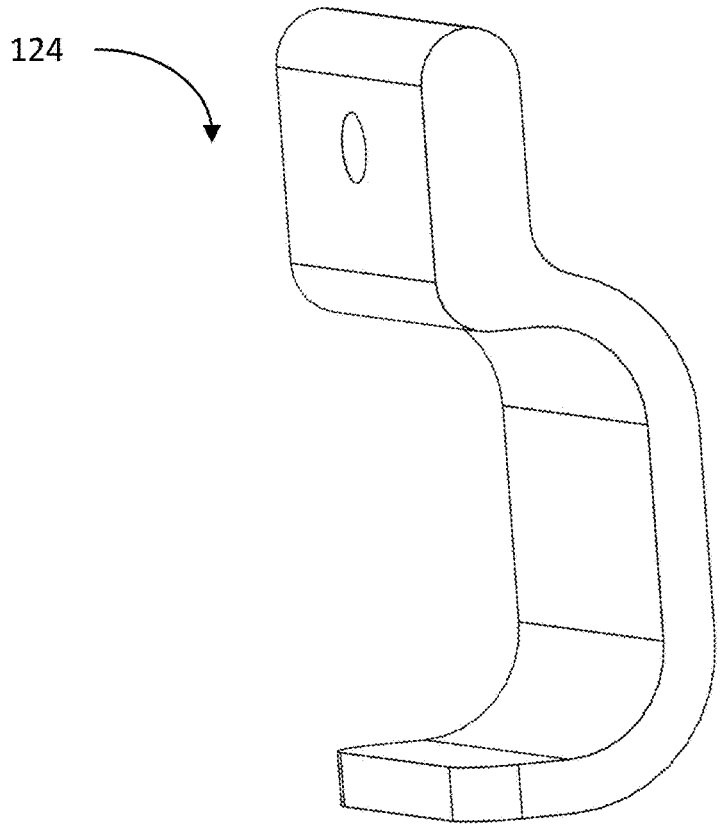
FIG. 8 further illustrates a jaw clamp member of the canopy in isolation.

FIG. 7 further illustrates the rim pivot member 134. In operation, the attached rims may pivot about a pivot point 135. FIG. 8 further illustrates a jaw clamp member 124 in isolation.

Figure 9:
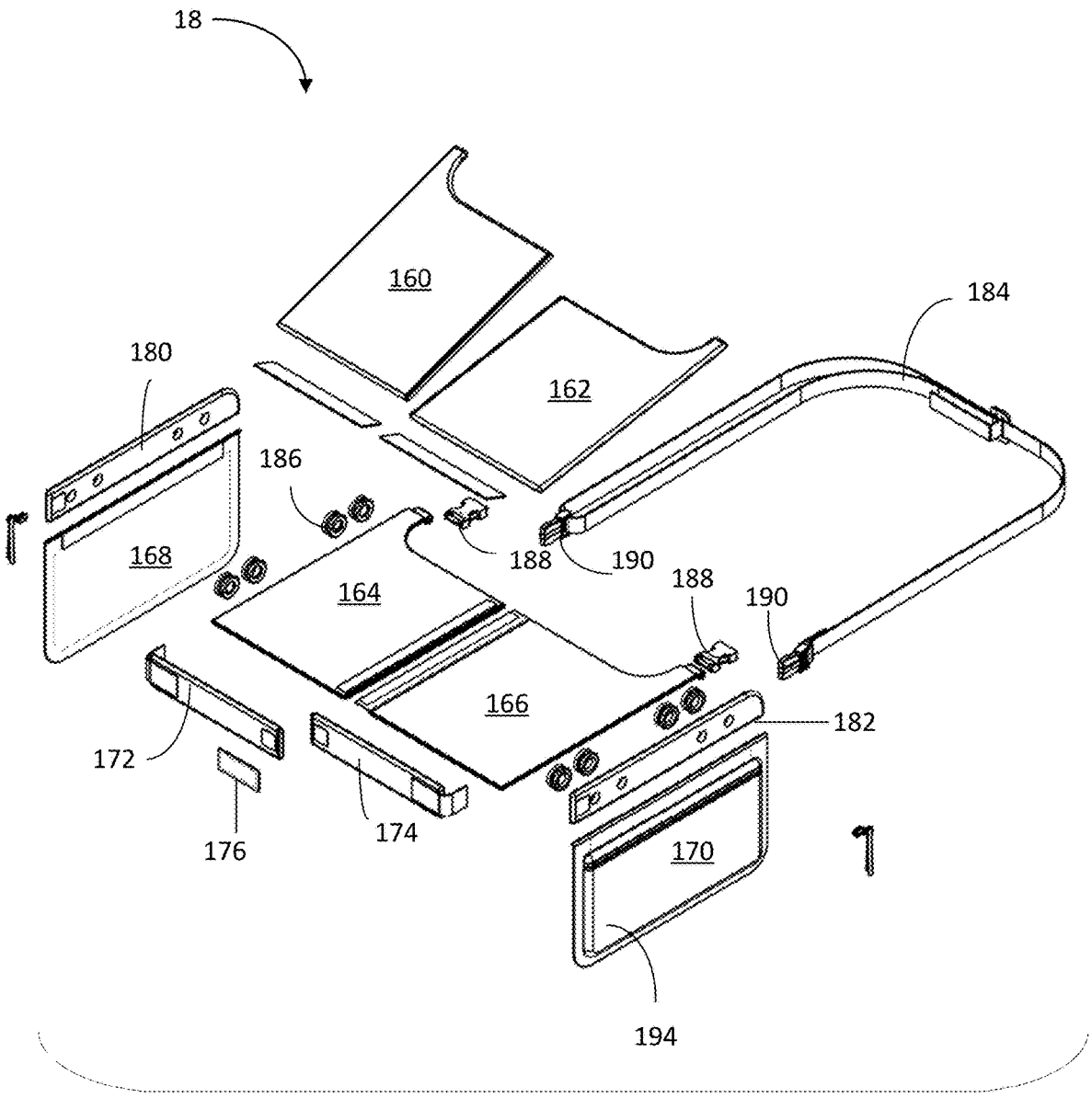
FIG. 9 illustrates an exploded view of the tray assembly in more detail.

FIG. 9 illustrates an exploded view of the tray assembly 18 in more detail. The tray includes top cushions 160, 162 and bottom tray surfaces 164, 166 which may be positioned thereunder. The bottom tray surfaces 164, 166 may be formed of vinyl or other material which is easy to clean. The tray assembly 18 may further include first and second opposite sides 168, 170 which may extend downwardly from the top of the tray. Top side sections 180, 182 are positioned at the top of the tray sides 168, 170. Front sections 172, 174 are positioned at a front of the tray assembly 18. A strap 176 may be positioned at the front of the tray to removably secure the opposite sides of the tray together.

A tray strap 184 is also shown which may connect to the tray assembly 18 on opposite sides. The tray strap 184 may be used to secure the tray assembly 18 around a back of the chair. In addition, buckles 188 on opposite sides of the tray may connect with buckles 190 of the strap. Other structural features are also shown. This includes, for example, various grommets 186 which may be fabric reinforcing grommets.

In use, the fabric portions of the tray such as the cushions 160, 162 which may be formed of padded fabric parts may be flipped up to expose tray surfaces 164, 166 which may be formed of vinyl and may be used for eating. The tray surfaces 164, 166 may be formed of vinyl or other materials which may be wiped down or otherwise sanitized.

Figure 10:
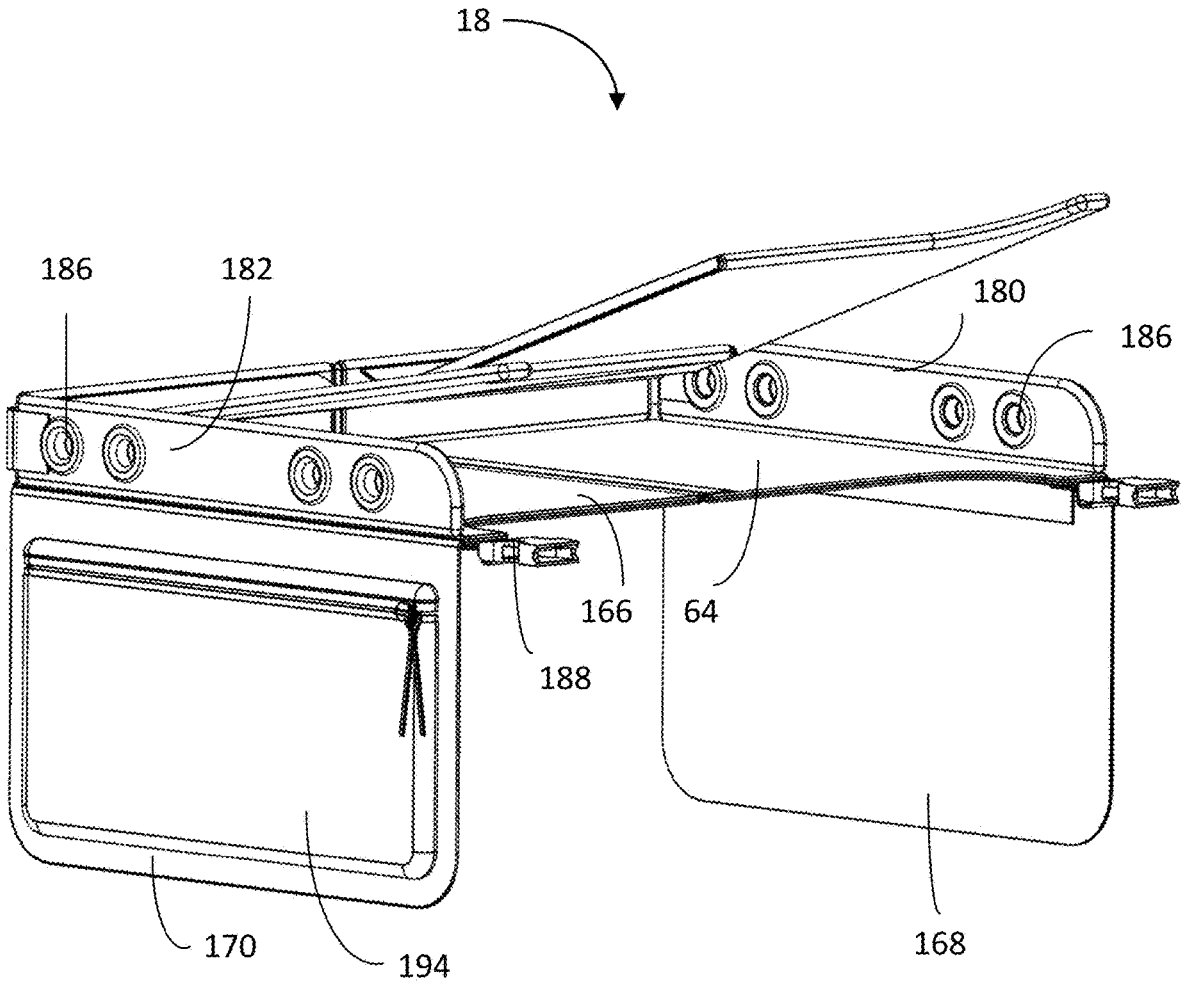
FIG. 10 is another view of the tray assembly.

FIG. 10 is another view of the tray assembly 18. Each of the first and second opposite sides 168, 170 may have a pocket 194 which may be a zippered pocket to hold additional items. Buckles such as buckle 188 may be used to connect the tray strap.

Figure 11:
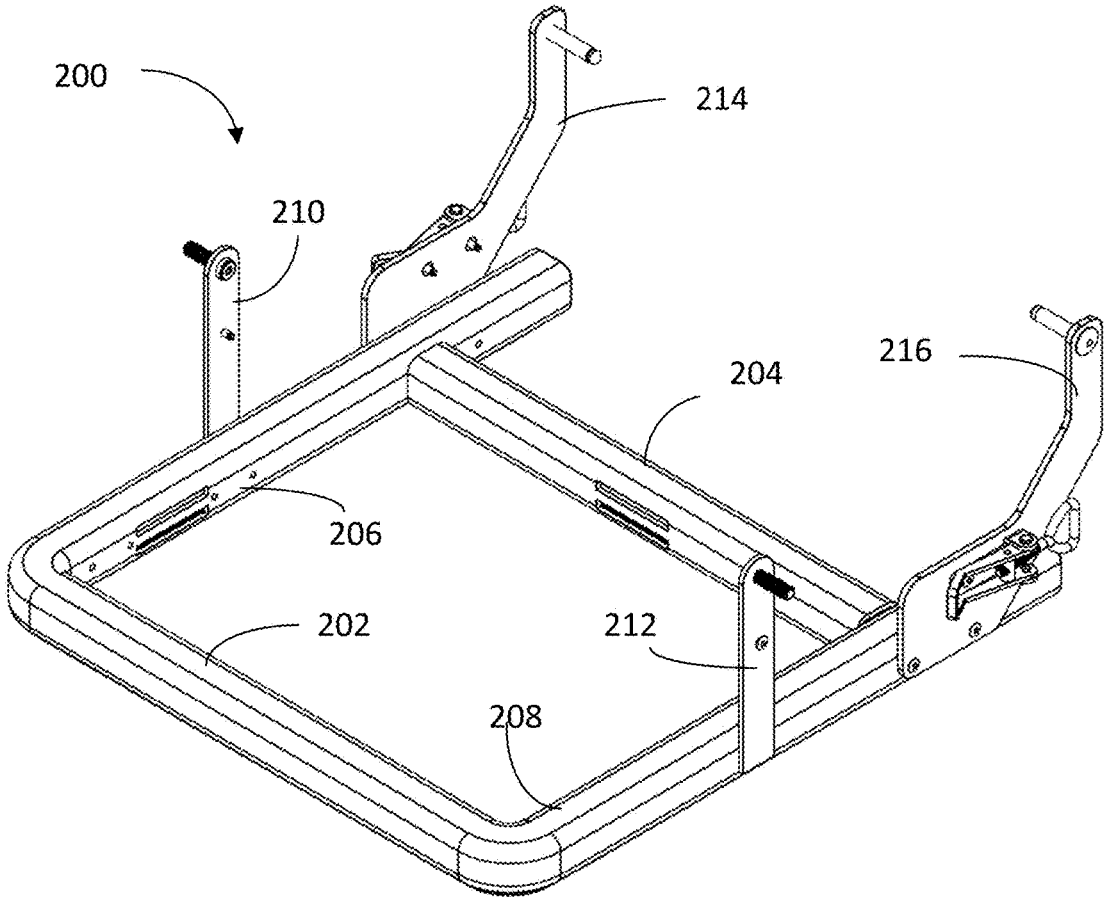
FIG. 11 illustrates the base frame of the chair.

FIG. 11 illustrates the base frame 200 of the chair. The base frame includes a plurality of frame members such as front frame member 202, rear frame member 204, and side frame members 206, 208. The frame members may be made of hollow metal or aluminum bars which are end capped. Of course, other types of frame members of different materials and geometries may be used. The base frame 200 may further include arm rest attachment members 210, 212 and seat back attachment members 214, 216.

Figure 12:
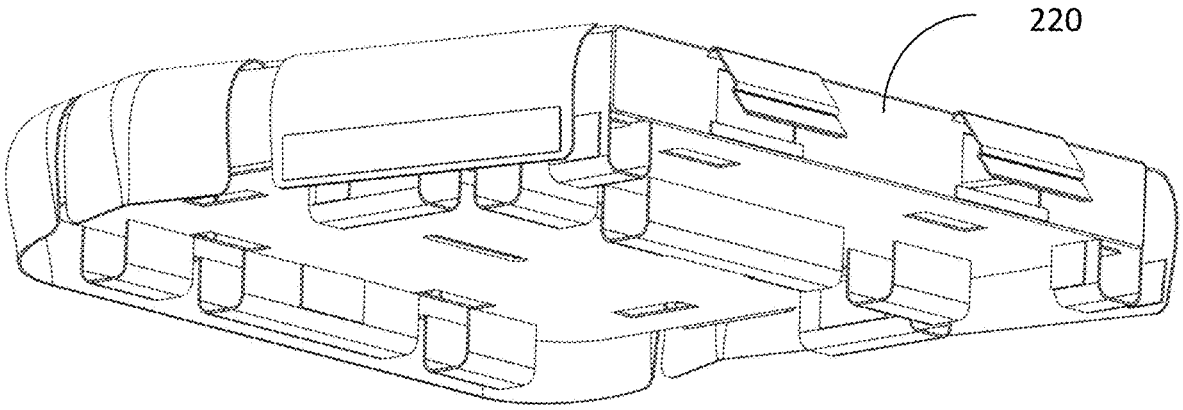
FIG. 12 illustrates one example of a seat which may be a fabric seat configured to be secured to the base frame of FIG. 11.

FIG. 12 illustrates one example of a seat 220 which may be a fabric seat configured to be secured to the base frame 200 of FIG. 11.

Figure 13:
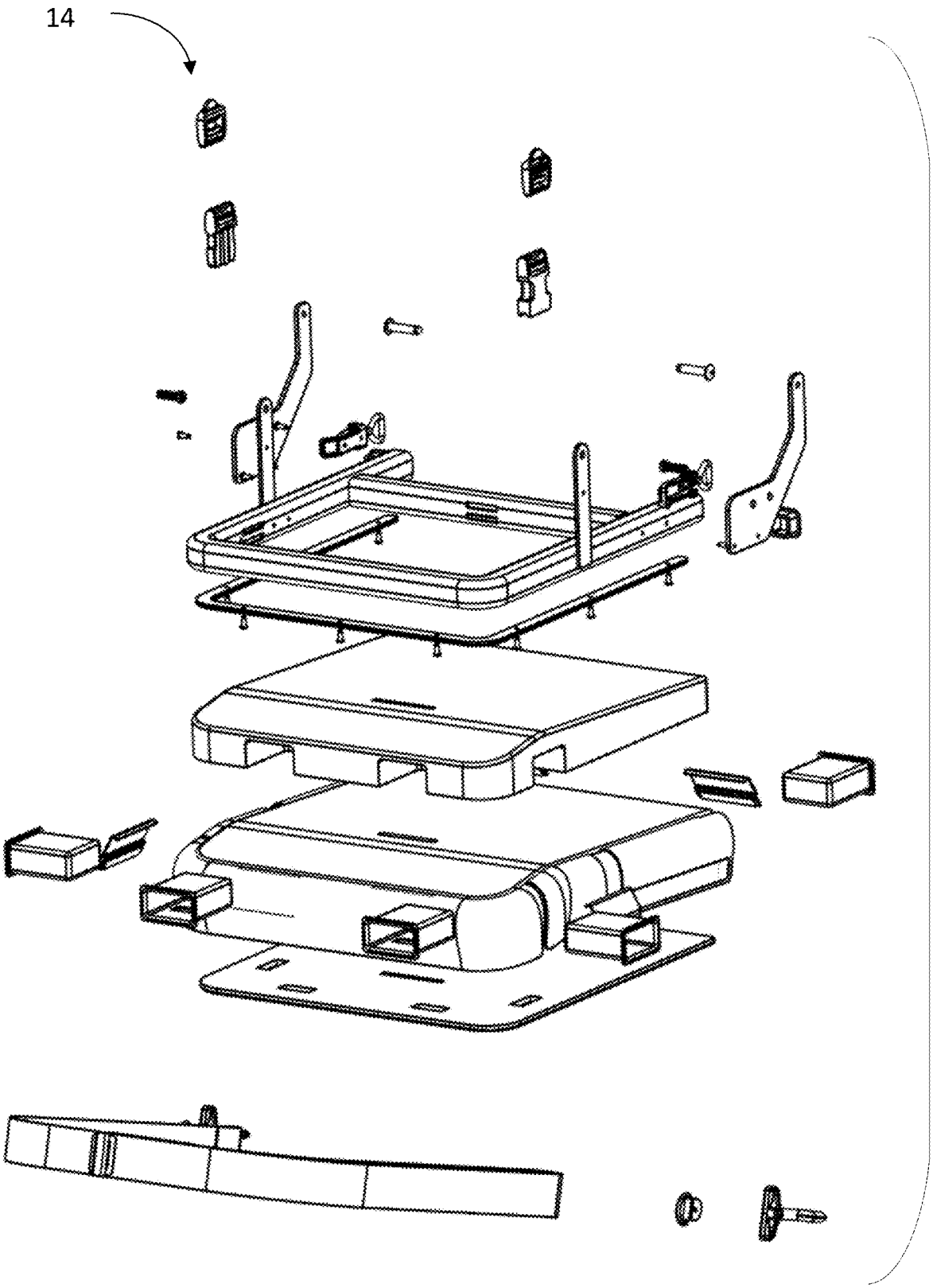
FIG. 13 illustrates an exploded view of portions of the base assembly.

FIG. 13 is an exploded view of portions of the base assembly 14. The base assembly may have multiple layers present.

Figure 14:
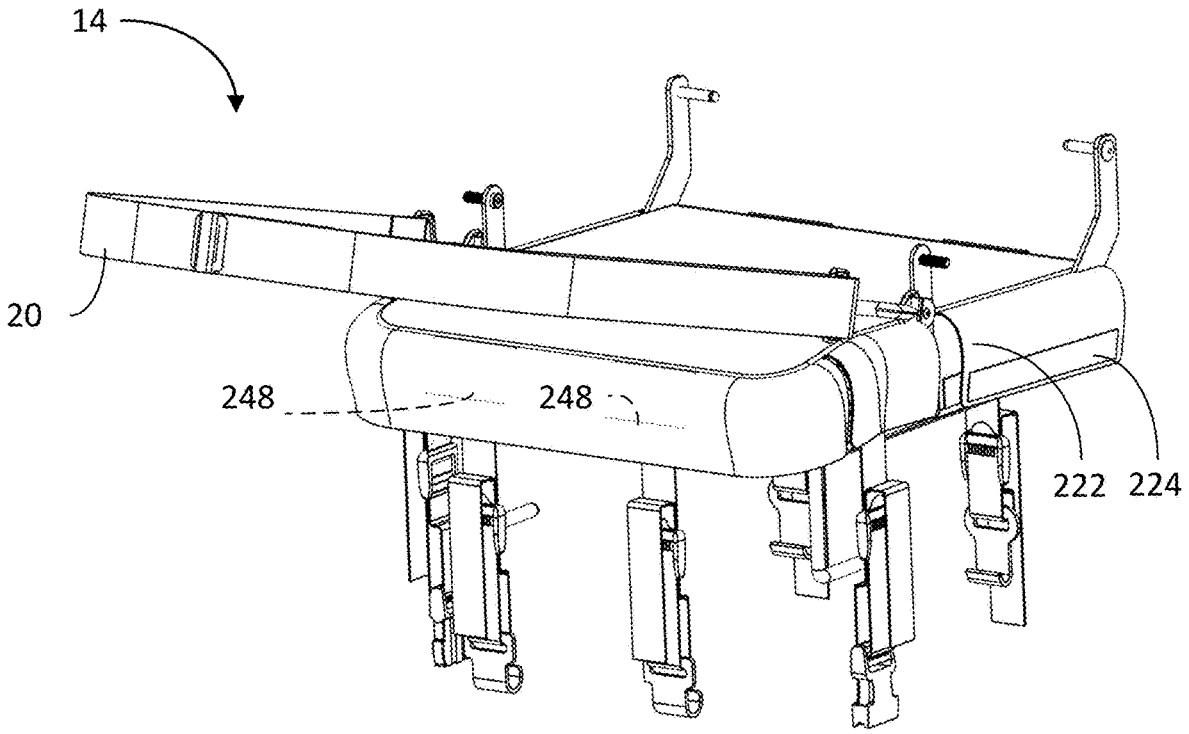
FIG. 14 is another view of the base assembly with a carrying strap present and various strap assemblies.

FIG. 14 is another view of the base assembly 14 with a carrying strap 20 present and various strap assemblies. A skirt 222 is shown which may be positioned around the base in order to protect the base assembly as well as covering the pockets 248 of the base assembly 14. A fabric connector 224 such as VELCO may also be positioned on the skirt 222.

Figure 15:
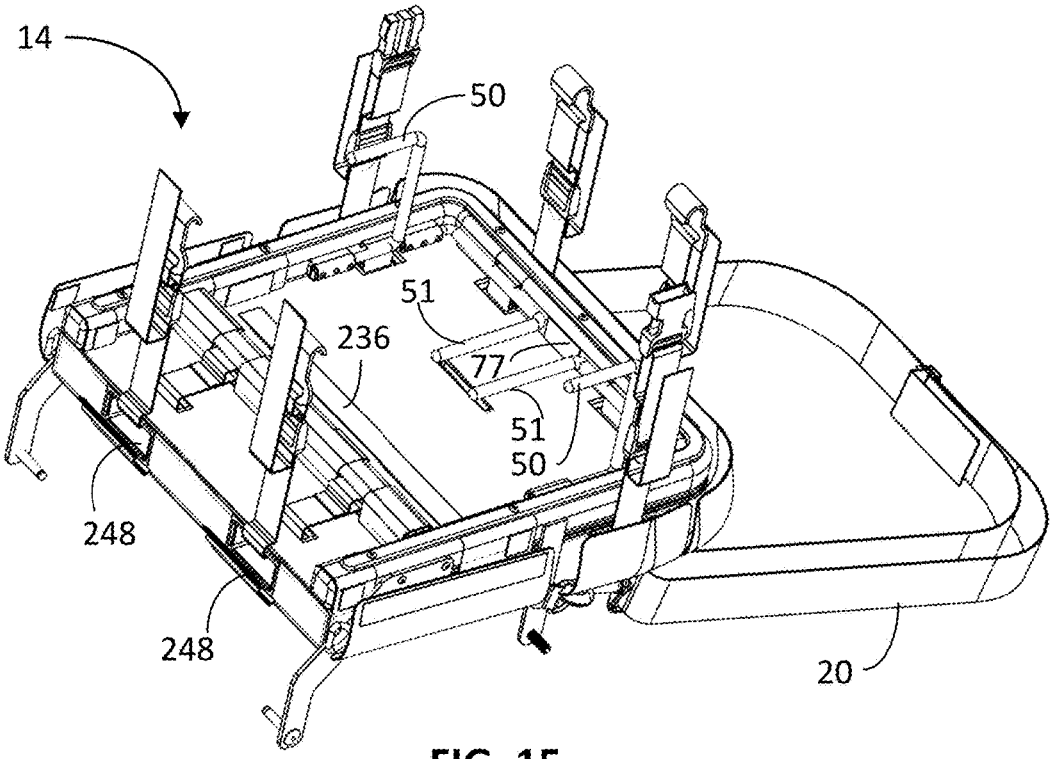
FIG. 15 illustrates a view of the base assembly showing placement of the sets of clamps.

FIG. 15 illustrates a view of the base assembly 14 showing placement of the sets of clamps. Note that there are two sets of clamps under the base of the front of the chair. A first set of front clamps 50 are in an operative position and a second set of front clamps 51 are in a stowed position. Note that the first set of front clamps 50 and the second set of front clamps 51 may be rotatably connected such that the clamps may be rotated into position to transition between the operative and stowed positions. There is also one set of clamps 52 under the base of the rear of the chair. The pockets 248 within the base assembly are also shown. The straps may be stored in the pockets 248 when not in use. Also shown in FIG. 15 is fabric connector 236 which may be formed from VELCRO material and may be used to add to the functionality and convenience of the chair. For example, a blanket (not shown) may be attached to the fabric connector 236 in order to hold the blanket in place. It is contemplated that blankets or other accessories may include fabric connectors as well. A front closure tab 77 which may be formed from a fabric connector such as VELCRO material is also shown which may be used such as when the chair is in a folded position.

Figure 16:
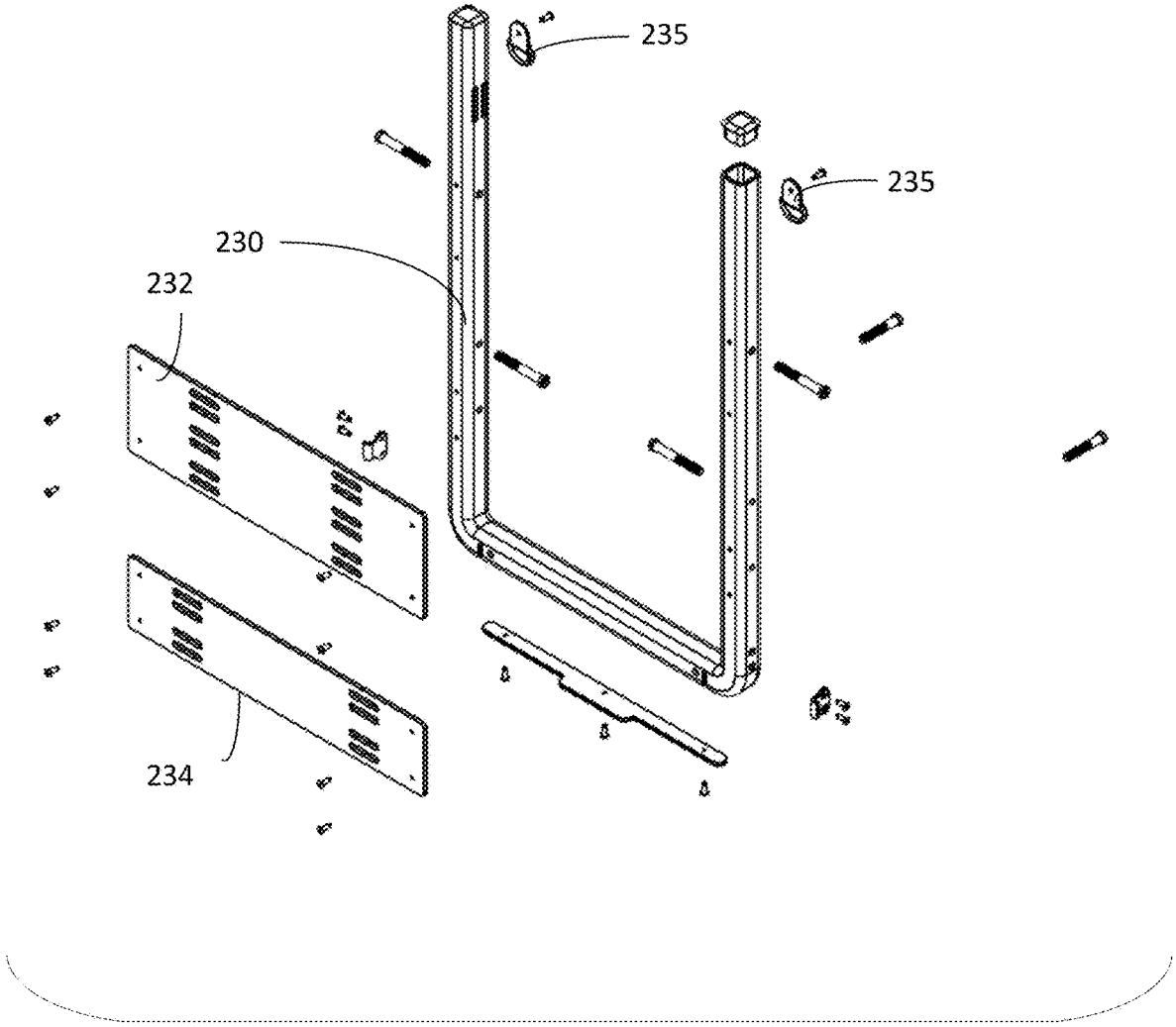
FIG. 16 illustrates a back frame which may be a u-shaped frame.

FIG. 16 illustrates a back frame 17 which may be a u-shaped frame. Secured to the back frame assembly may be shoulder frame harness support 232 positioned above a waist frame harness support 234. The shoulder frame harness support 232 provides additional support for attachment of a shoulder harness while the waist frame harness support 234 provides additional support for attachments of a waist harness. Additional components such as fasteners are shown which may be used as shown.

Figure 17:
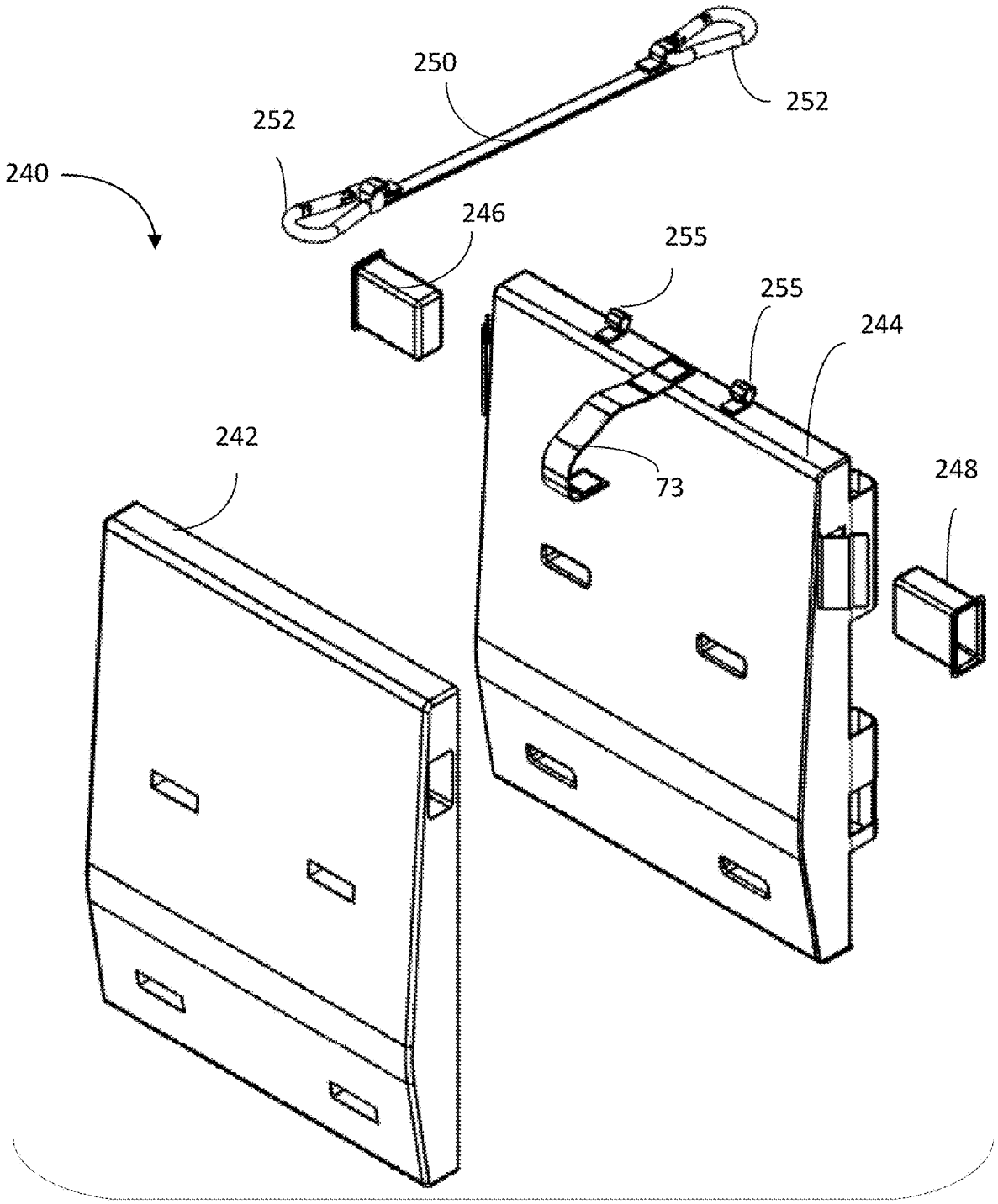
FIG. 17 illustrates a back cushion assembly for attachment to the back frame of FIG. 14 which forms a part of the back frame assembly.

FIG. 17 illustrates a back cushion assembly 240 for attachment to the back frame of FIG. 11 which forms a part of the back frame assembly. The back cushion assembly 230 includes a back cushion 242 which may be operatively connected to a back cover 244. Within the back cover 244 there are a plurality of insets in which pockets 246, 248 may be positioned. The pockets 246, 248 may be used to hold straps or other accessories. A lanyard 250 is also shown which may have carabiners 252 on opposite ends. A closure tab 73 is shown which may be used for the securing the back frame assembly to the base assembly. Also shown are fabric loops 255 which may be used for any number of purposes including to hold accessories.

Figure 18:
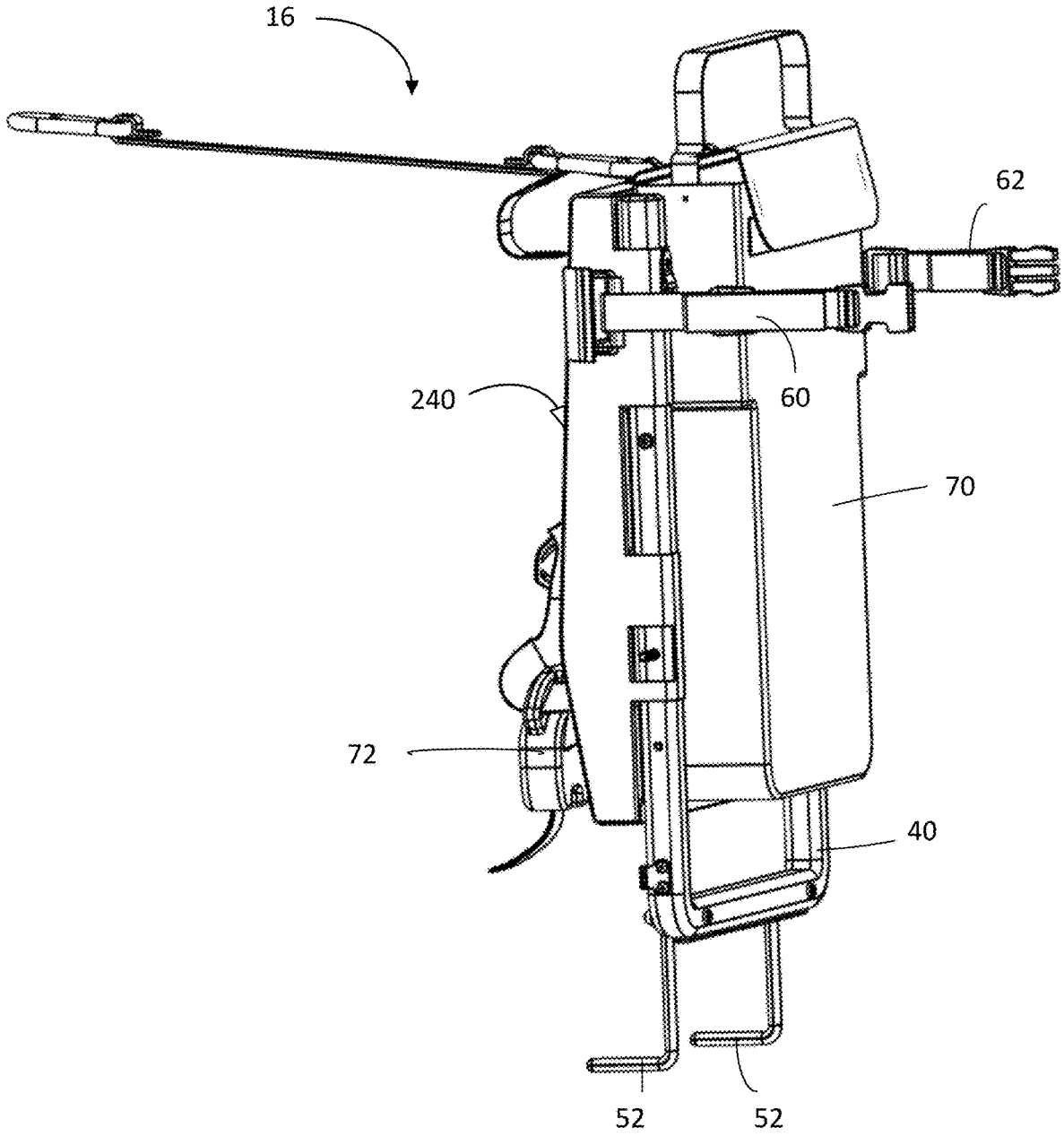
FIG. 18 is another view of the back assembly.

FIG. 18 is another view of the back assembly 16. Both the back cushion assembly 240 is shown as well as the pouch 70. Note that the strap assemblies 60, 62 may be buckled together around the pouch 70 to secure it in place in addition to attachment using VELCRO material or other hook and loop type fasteners.

Figure 19:
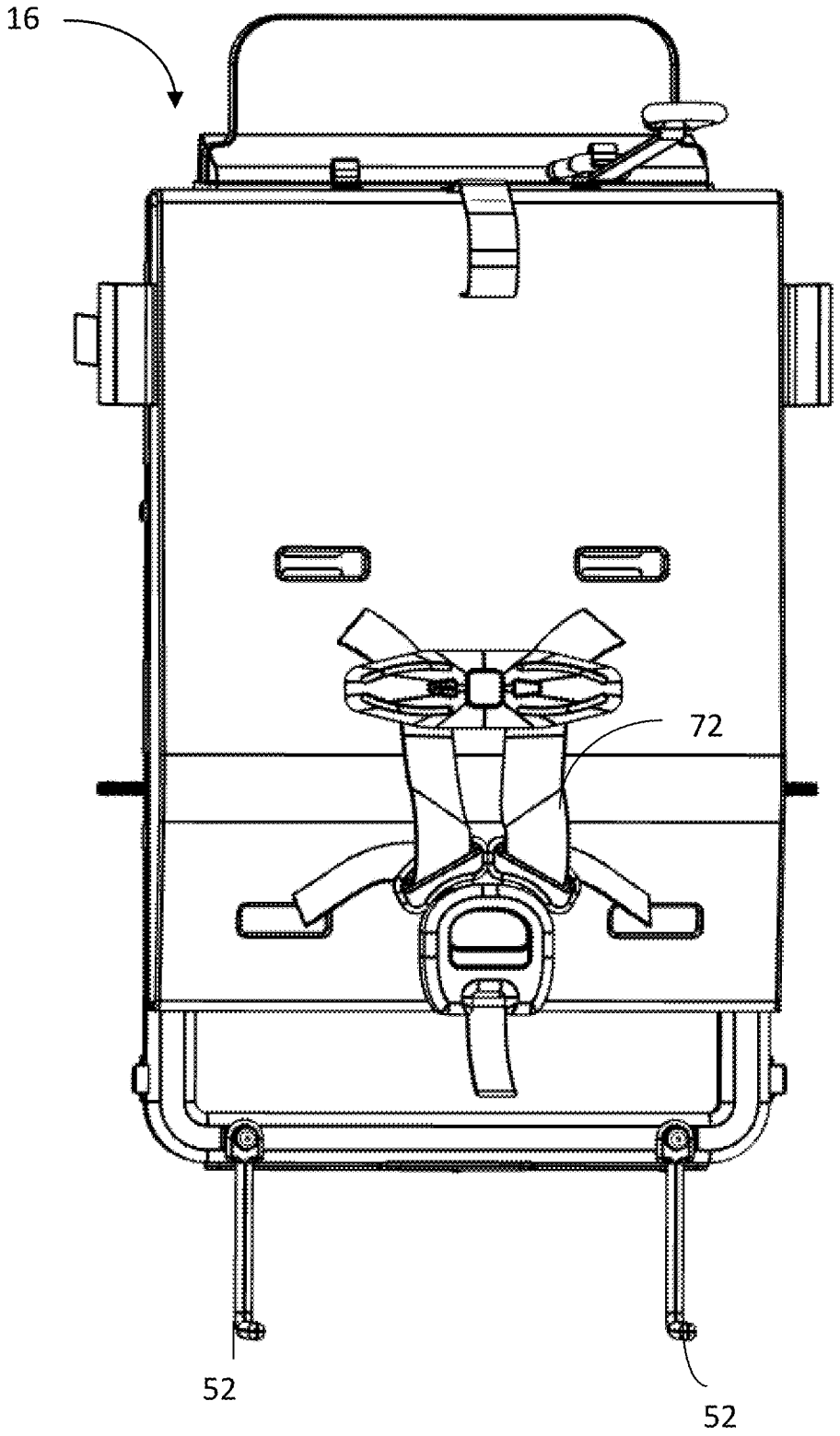
FIG. 19 is a further view of the back assembly.

FIG. 19 is a further view of the back assembly 16. The harness 72 is shown which may be a 5 point harness for securing the shoulders as well as waist of an individual.

Figure 20:
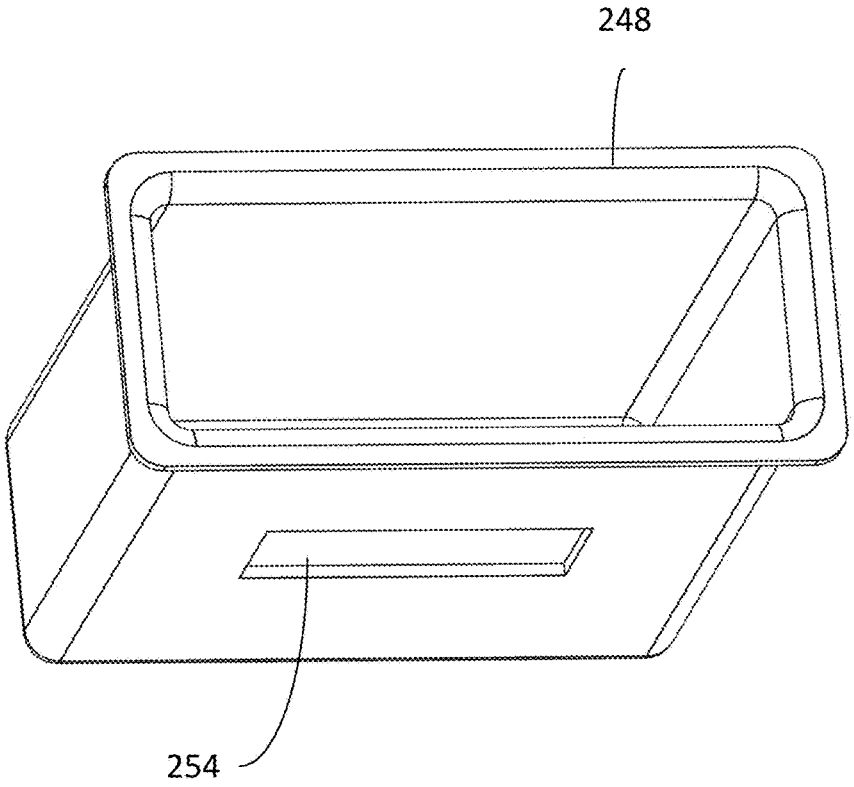
FIG. 20 illustrates an inset pocket which may be used to hold straps.

FIG. 20 illustrates an inset pocket 248 which may be used to hold straps. There may be an opening 254 in the form of a slot within the inset pocket 248.

Figure 21:
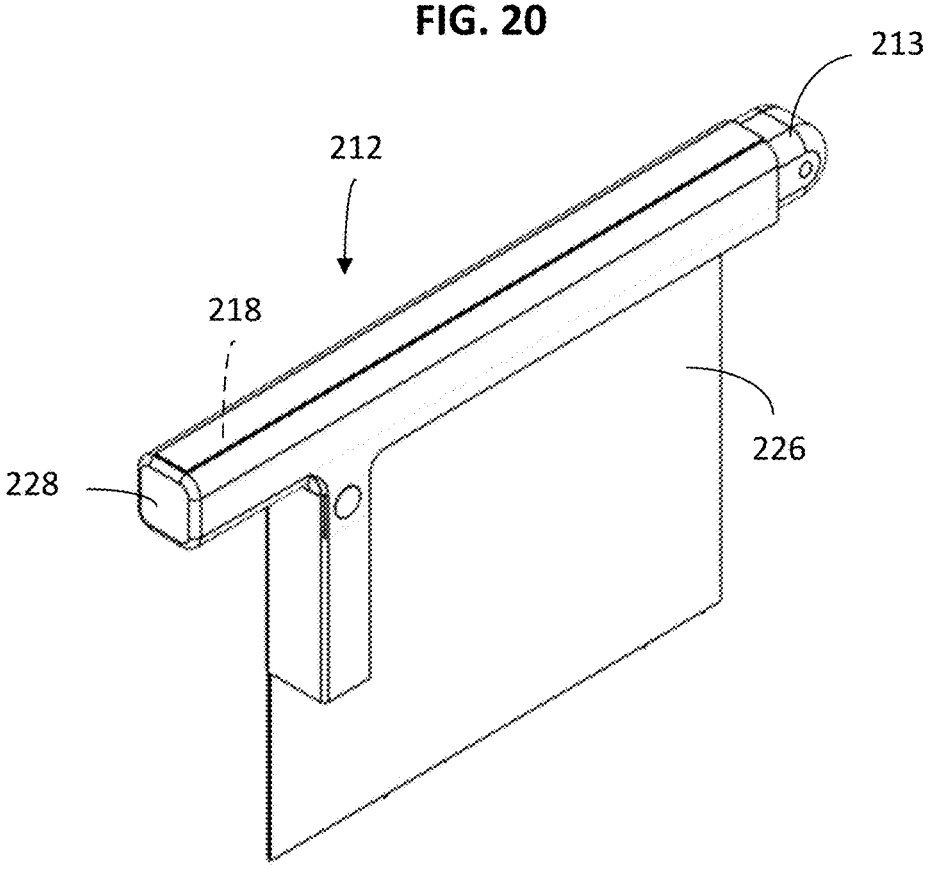
FIG. 21 illustrates a view of an arm rest.

FIG. 21 illustrates a view of an arm rest 212. The arm rest 212 may have multiple parts. This may include an arm 218 which is protected by an arm rest cover 226 which may provide for additional padding or cushion to be added to the arm rest. The arm rest cover may completely surround the arm 218 so that the arm 218 is not exposed in order to provide additional safety and comfort. The arm rest pivot 213 which attaches to the back frame assembly allows the arm 218 to rotate downward or upward to a closed or open position. On the opposite end of the arm 218 is an end cap 228 which may be inserted into an open end of the arm 218. The arm rest cover 226 is removable. In addition, the arm rest 212 is removable as the arm 218 may be removed. One situation where the arm rest 212 may be removed is where the chair is being used with a juvenile with adaptive needs or if removal of the arm rest 212 provides more comfort.

Figure 22:
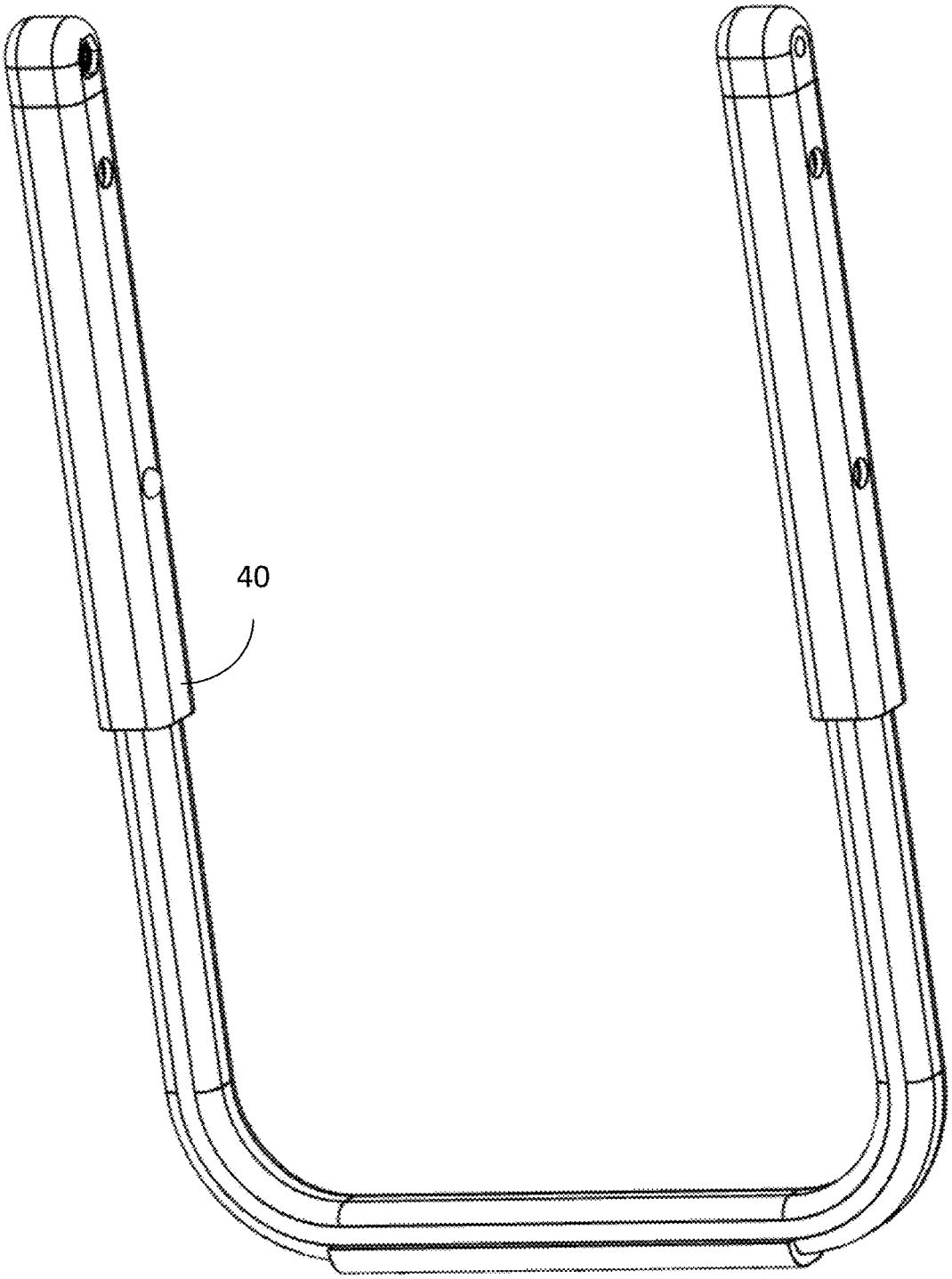
FIG. 22 is another view of a kickstand.

FIG. 22 is another view of a kickstand. The kickstand may be configured to include a plurality of different positions to allow the chair to be supported at different angles. In addition, instead of connecting a kickstand at the back of the base assembly, more than one kickstand may be used which are positioned under the base of the chair which allow the kickstands to serve as legs for the chair. The legs where present may be mounted on left and right opposite sides of the base and may be telescoping in nature to allow for adjustments to different heights. The legs where present may be folded up into the base when not in use. In some embodiments, a kickstand may be used to provide a front leg by mounting to the front of the base assembly which pivot forwards to position the front leg at the front of the chair.

Figure 23:
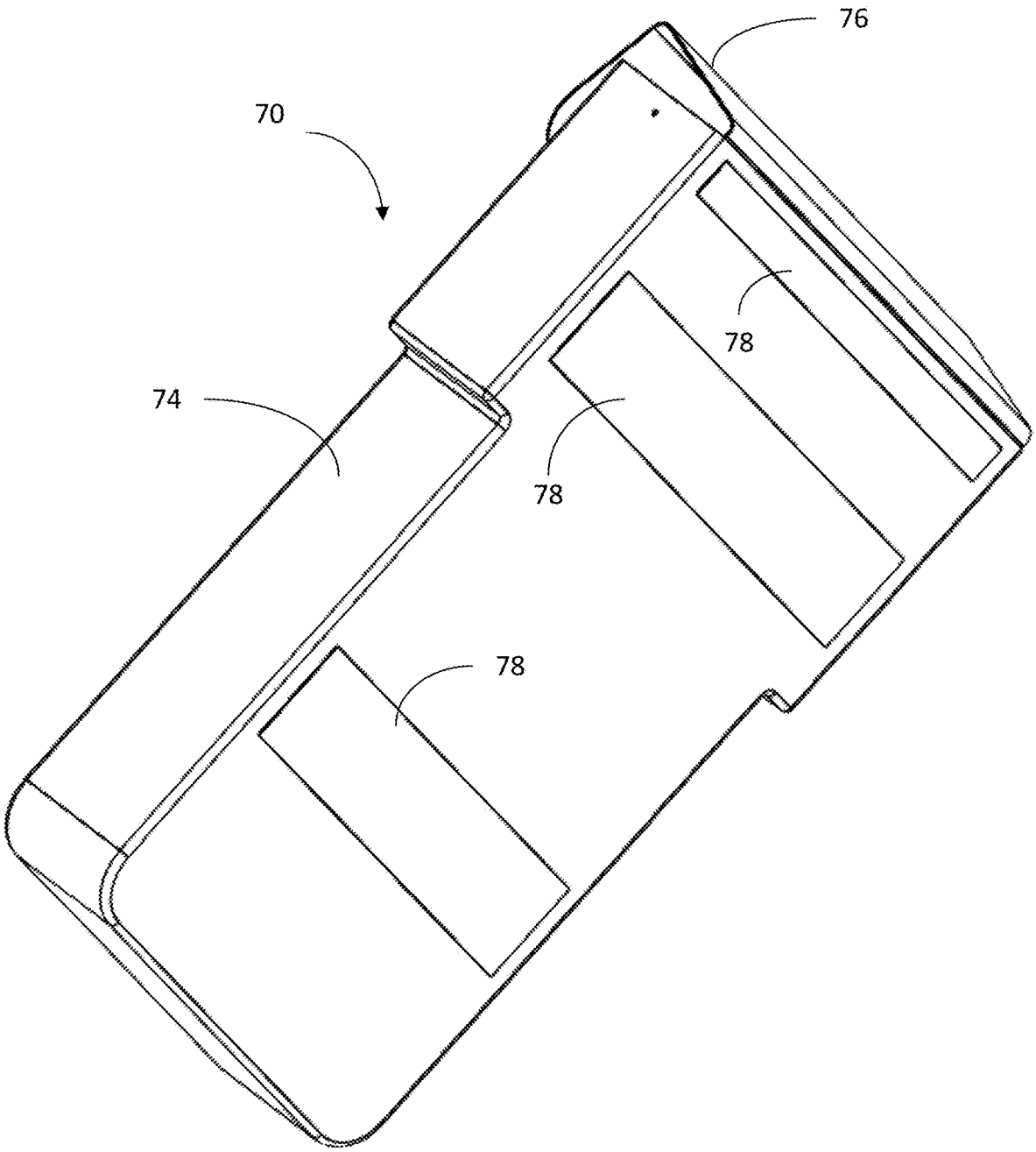
FIG. 23 illustrates one view of a pouch.

FIG. 23 illustrates one example of the pouch 70. The pouch 70 may have a main body 74 and a flap 76 which may be secured to the main body 74. The pouch 70 may include multiple fabric fasteners 78 such as VELCRO material or hook and loop fasteners which are used to secure the pouch 70 to the back assembly of the chair or otherwise. It is to be understood that various components of the chair may be placed within the pouch 70 when the components are not in use. Alternatively, or additionally, other items may be placed within the pouch 70 for storage or transport.

Figure 24:
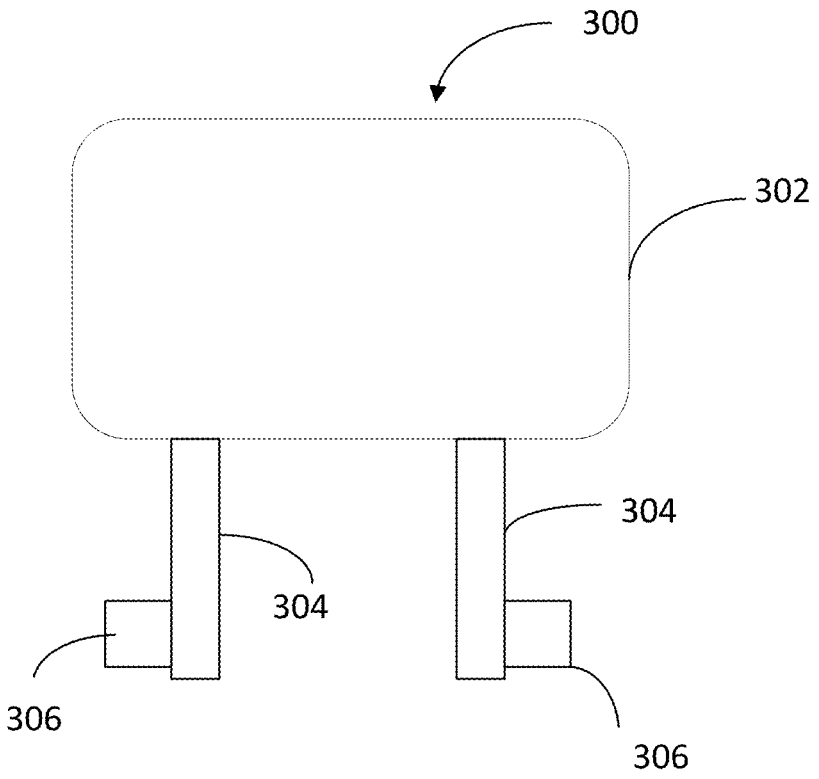
FIG. 24 illustrates one example of a headrest for attachment to the chair.

FIG. 24 illustrates one example of a headrest 300. A headrest 300 may include a cushion 302. One or more arms 304 may extend downwardly from the headrest assembly to fit within holes within the back assembly. Knobs 306 with threaded studs (not shown) may be used to securely mount the headrest in a manner similar to the mounting of the canopy. When the headrest 300 is not in use it may be placed within the pouch of the chair.

Figure 25:
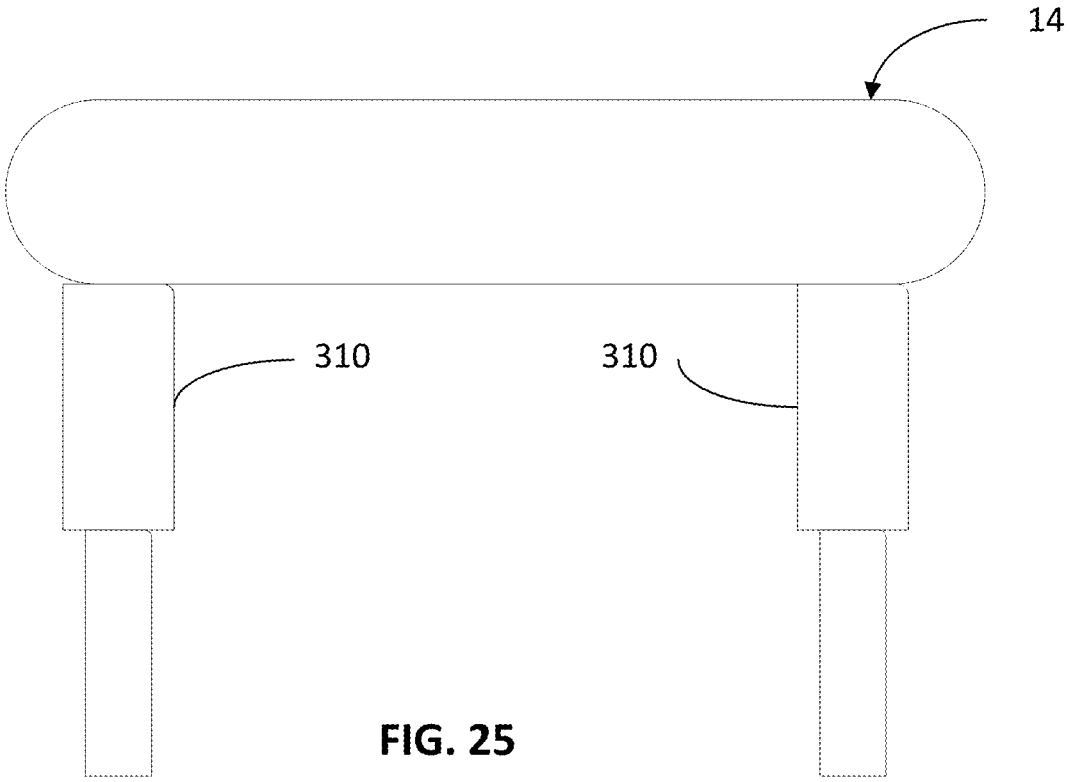
FIG. 25 illustrates one example of the base assembly where legs are pivotably connected to the base assembly of the chair.

FIG. 25 illustrates one example of the base assembly 14 where legs 310 are pivotably connected to the base assembly. The legs 310 may be telescoping legs to allow for additional extension in a manner similar to the kickstand. The legs 310 may be present on the front and back of the chair to allow for the base assembly 14 to be elevated off of the ground. Of course, the legs 310 may be otherwise positioned on the chair. For example, the legs 310 may alternatively connect at the sides of the chair or any other position of the chair. It should further be appreciated that any number of different legs 310 may be used in any number of different locations. The specific configuration used may depend upon the amount of weight to be supported, the types of materials used, the desired length of the legs, weight distribution constraints, or other factors. Thus, the legs 310 may be positioned to provide balance and stability of an upright chair in any suitable location.

Therefore a portable chair has been shown and described. Numerous options, variations, and alternatives are contemplated. In addition, the chair as described provides numerous benefits and advantages. For example, the chair provides for added stability and safety in numerous ways. For example, where the chair includes a first and a second set of clamps at the front and back of the base assembly, the claims securely attach the chair to a variety of surfaces, minimizing the risk of the chair tipping over or falling off. This may be especially important in ensuring the safety of young children. Because the chair may be equipped with a seat cushion fit to the base frame, along with left and right arm rests that extend vertically, the chair may provide comfort and support for a child, helping maintain proper posture and comfort during use. Additional support may also be provided where a kickstand connected to the back assembly can be pivoted out to provide extra stability when the chair is in use. This feature is particularly useful on uneven surfaces or when additional support is needed to prevent the chair from moving or rocking or to place the chair on a ground surface. The chair provides additional features related to it utility and storage due to the pouch and pockets or compartments, many items may be stored including toys, snacks, or baby essentials. These features help keep necessary items within easy reach, enhancing convenience for caregivers. The chair also provides protection from elements where the canopy is present. The canopy with multiple rims and a covering offers protection from the sun, wind, or precipitation, making the chair suitable for outdoor use. This ensures that the child remains comfortable and protected in various weather conditions. Moreover, the canopy may be easy to use and further provides privacy. The canopy is secured with a first and second clamp assembly, each featuring a jaw claw lock handle and a knob on a threaded stud for easy adjustment and firm attachment. This arrangement allows for quick setup and breakdown while ensuring the canopy remains stable and secure. The tray assembly attachable to the arm rests includes a left and right side, each with a protective surface over a cushion. This feature provides a safe and clean space for eating or playing, enhancing the chair's functionality for longer periods of sitting. The chair is also portable and may be folded and carried with a carrying strap. This is especially useful for families on the go, as it simplifies moving the chair between locations. The chair also provides for organizational Convenience in that the removable pouch connected to the rear of the back assembly is sized to store the removable canopy and tray, facilitating organization and transport. This feature helps keep all components together and protected when the chair is not in use. Thus, the chair may be portable, versatile, safe, and comfortable for young children with additional features that cater to the practical needs of parents or caregivers in various environments.

When used for an adult, the chair still provides benefits of stability and security as the dual sets of clamps on the front and back of the base assembly securely anchor the chair to a variety of surfaces, such as bleachers or benches. This ensures that the chair remains stable and does not slip or shift during use, providing a safe seating option during sporting events. The chair also provides a number of comfort features including a seat cushion and vertical arm rests enhance comfort, reducing discomfort during long periods of sitting. The back assembly offers additional back support and stability, which is important for maintaining comfort during extended periods, such as a full-day sporting event. Where the canopy is used, the canopy provides for protection from elements and is a significant advantage for outdoor events, offering protection from the sun, shields from precipitation allowing an individual to endure uncomfortable weather and better enjoy a sporting event, for example. Various features further provide convenience and utility. The inclusion of multiple pockets and a large pouch reduces the need to carry an additional bag. The tray assembly serves as a convenient surface for food and beverages or for holding personal items, keeping everything organized and within easy reach. The adjustable canopy and tray are easy to install and remove, due to the clamp assemblies with user-friendly jaw claw lock handles and knobs. This feature allows for quick adjustments as needed, such as repositioning the canopy based on the sun's angle. In addition, the chair is truly portable as its carrying strap and compact design make it easy to transport and store. This is particularly beneficial for sports fans who may need to carry the chair from parking lots to seating areas at different venues. The removable pouch also simplifies storing and protecting the canopy and tray during transit. The chair is also versatile to accommodate a range of outdoor settings, making it not only suitable for sports events but also for other activities such as camping, fishing, or picnicking. This versatility adds value, as the chair can be used for a variety of purposes in a variety of environments.

Because of the various features described the portable chair is also suitable to offer enhanced stability, comfort, convenience, safety, and accessibility to individuals with disabilities. These attributes help enable greater participation in a variety of outdoor and indoor events, may help promote a sense of independence and improve overall quality of life.

The invention claimed is:

1. A portable chair comprising:

a base assembly comprising a base frame and a seat cushion fit to the base frame;

a back assembly operatively connected to the base assembly;

a first set of front clamps operatively connected to the base assembly in an operative position configured to extend downwardly therefrom to secure the portable chair to a front of a surface and in a stowed position positioned underneath the base assembly; and a set of back clamps operatively connected to the base assembly and in an operative position configured to extend downwardly therefrom to further secure the portable chair to a back of the surface and in a stowed position positioned underneath the base assembly;

a set of front strap assemblies positioned at a front of the base assembly and terminating at hook ends; and a set of back strap assemblies positioned at a back of the base assembly and terminating at hook ends;

wherein each of the first set of front clamps and each of the set of back clamps comprises a rigid body having a first portion for extending along an edge of a bleacher or seat when in the operative position and a second portion extending perpendicularly from the first portion for extending under the bleacher or seat to thereby clamp the portable chair to the bleacher or seat when in the operative position.

2. The portable chair of claim 1 further comprising a second set of front clamps sized differently than the first set of front clamps and in an operative position configured to extend downwardly from the base assembly to secure the portable chair to the front of the surface and in a stowed position positioned underneath the base assembly.

3. The portable chair of claim 1 further comprising a left arm rest operatively connected to the back assembly and a right arm rest pivotably connected the back assembly.

4. The portable chair of claim 1 further comprising a kickstand pivotably connected to the back assembly and configured to support the portable chair when the kickstand is pivoted away from the back assembly.

5. The portable chair of claim 1 further comprising a plurality of pockets inset in the base assembly.

6. The portable chair of claim 1 further comprising a canopy comprising a plurality of rims and a covering.

7. The portable chair of claim 6 further comprising a first clamp assembly and a second clamp assembly for securing opposite sides of the canopy to the back assembly.

8. The portable chair of claim 7 wherein each of the first clamp assembly and the second clamp assembly comprises a jaw claw lock handle and a knob attached to a threaded stud.

9. The portable chair of claim 3 further comprising a tray assembly for attaching to the left arm rest and the right arm rest.

10. The portable chair of claim 9 wherein the tray assembly extends between the left arm rest and the right arm rest and the tray assembly further comprises a cushion and a protective surface.

11. The portable chair of claim 10 further comprising a carrying strap operatively connected to the tray assembly.

12. The portable chair of claim 1 further comprising a pouch removably connected to a rear of the back assembly and wherein the pouch is sufficiently sized to contain a removable canopy of the portable chair and a removable tray of the chair.

13. A portable chair comprising:

a base assembly comprising a base frame and a seat cushion fit to the base frame;

a back assembly operatively connected to the base assembly;

a first set of clamps operatively connected to the base assembly underneath a front of the base assembly and configured to extend downwardly therefrom to secure the portable chair to a surface;

a second set of clamps operatively connected to the base assembly underneath a back of the base assembly and configured to extend downwardly therefrom to further secure the portable chair to the surface;

a set of front strap assemblies positioned at a front of the base assembly and terminating at hook ends;

a set of back strap assemblies positioned at a back of the base assembly and terminating at hook ends;

a left arm rest operatively connected to the back assembly and a right arm rest operatively connected to the back assembly;

a kickstand pivotably connected to the back assembly and configured to support the portable chair when the kickstand is pivoted away from the back assembly; and wherein each of the first set of clamps and each of the second set of clamps comprises a rigid body having a first portion for extending along an edge of a bleacher or seat when in the operative position and a second portion extending perpendicularly from the first portion for extending under the bleacher or seat to thereby clamp the portable chair to the bleacher or seat when in the operative position.

14. The portable chair of claim 13 further comprising a tray assembly for attaching to the left arm rest and the right arm rest.

15. The portable chair of claim 14 wherein the tray assembly includes a left side and a right side separated from the left side and wherein both the left side and the right side comprise a cushion overlaying a protective surface.

16. The portable chair of claim 15 further comprising a canopy comprising:

a plurality of rims and a covering; and a first clamp assembly and a second clamp assembly for securing opposite sides of the canopy to the back assembly;

wherein each of the first clamp assembly and the second clamp assembly comprises a jaw claw lock handle and a knob attached to a threaded stud.

17. The portable chair of claim 16 further comprising a pouch removably connected to a rear of the back assembly and wherein the pouch is sufficiently sized to contain the canopy of the portable chair and the tray assembly of the chair.

18. The portable chair of claim 17 further comprising a head rest removably connected to the back assembly and sized to fit within the pouch.

19. The portable chair of claim 13 further comprising at least one retractable leg operatively connected to the base assembly.

20. A portable chair comprising:

a base assembly comprising a base frame and a seat cushion fit to the base frame;

a back assembly operatively connected to the base assembly;

a first set of front clamps operatively connected to the base assembly in an operative position configured to extend downwardly therefrom to clamp the portable chair to a front of a surface and in a stowed position positioned underneath the base assembly;

a set of back clamps operatively connected to the base assembly and in an operative position configured to extend downwardly therefrom to further clamp the portable chair to a back of the surface and in a stowed position positioned underneath the base assembly;

a set of front strap assemblies positioned at a front of the base assembly and terminating at hook ends; and a set of back strap assemblies positioned at a back of the base assembly and terminating at hook ends;

wherein each of the first set of front clamps and each of the set of back clamps comprises a rigid body having a first portion for extending along an edge of a bleacher or seat when in the operative position and a second portion extending perpendicularly from the first portion for extending under the bleacher or seat to thereby clamp the portable chair to the bleacher or seat when in the operative position.

* * * * *